US009458659B2

(12) United States Patent
Thorndyke et al.

(10) Patent No.: US 9,458,659 B2
(45) Date of Patent: Oct. 4, 2016

(54) UNIVERSAL ADAPTOR AND METHODS FOR INSTALLING FENESTRATION PRODUCTS

(71) Applicant: PROFILE UNIVERSAL WINDOW ADAPTER LLC, Peninsula, OH (US)

(72) Inventors: Carrie A. Thorndyke, Rootstown, OH (US); Jon A. Neely, Conway, PA (US)

(73) Assignee: PROFILE UNIVERSAL WINDOW ADAPTER, LLC, Peninsula, OH (US)

( * ) Notice: Subject to any disclaimer, the term of this patent is extended or adjusted under 35 U.S.C. 154(b) by 0 days.

(21) Appl. No.: 14/293,161

(22) Filed: Jun. 2, 2014

(65) Prior Publication Data

US 2014/0373482 A1 Dec. 25, 2014

Related U.S. Application Data

(60) Provisional application No. 61/838,471, filed on Jun. 24, 2013.

(51) Int. Cl.
*E04C 2/38* (2006.01)
*E06B 1/62* (2006.01)

(52) U.S. Cl.
CPC ..... *E06B 1/62* (2013.01); *E06B 2001/628* (2013.01)

(58) Field of Classification Search
CPC ..... E06B 1/045; E06B 1/36; E06B 1/56; E06B 1/34; E06B 1/04; E06B 1/68; E06B 3/20; E06B 3/96; E06B 2001/628; E06B 1/62; E06B 3/4618; E06B 1/02; E06B 1/30; E06B 1/32
See application file for complete search history.

(56) References Cited

U.S. PATENT DOCUMENTS

| | | | | |
|---|---|---|---|---|
| 1,568,865 | A * | 1/1926 | Barr | 49/142 |
| 4,513,549 | A * | 4/1985 | Wendt | E06B 3/9885 52/211 |
| 5,392,574 | A * | 2/1995 | Sayers | 52/217 |
| 5,577,355 | A | 11/1996 | Leonelli | |
| 5,651,222 | A * | 7/1997 | Bridges et al. | 52/211 |
| 5,706,620 | A | 1/1998 | De Zen | |
| 5,713,159 | A | 2/1998 | Schmidt | |
| 6,526,709 | B1 * | 3/2003 | Jacobsen | E06B 1/02 52/202 |
| 6,631,595 | B1 * | 10/2003 | Minter | E06B 1/62 49/504 |
| 8,402,707 | B2 | 3/2013 | Mitchell et al. | |
| 8,490,350 | B1 * | 7/2013 | Greely et al. | 52/213 |
| 8,596,000 | B2 | 12/2013 | Mitchell et al. | |
| 2003/0221381 | A1 * | 12/2003 | Ting | 52/204.1 |
| 2005/0050815 | A1 * | 3/2005 | Engebretson | 52/204.52 |
| 2005/0072073 | A1 * | 4/2005 | Inelli | E06B 1/30 52/204.1 |
| 2006/0143996 | A1 * | 7/2006 | Alvarado | E06B 1/02 52/504.53 |
| 2006/0272238 | A1 * | 12/2006 | Honda | 52/211 |
| 2008/0134595 | A1 * | 6/2008 | Collins | E06B 1/62 52/204.5 |
| 2009/0044466 | A1 * | 2/2009 | Andres | 52/204.53 |
| 2014/0174007 | A1 * | 6/2014 | Massey | 52/204.53 |

* cited by examiner

*Primary Examiner* — Brian Mattei
(74) *Attorney, Agent, or Firm* — Timothy D. Bennett; Emerson Thomson Bennett

(57) ABSTRACT

A universal adaptor may be used to secure a fenestration product to a structure having an opening. The universal adaptor may include an adaptor piece sized to be received on each periphery portion of the opening.

10 Claims, 36 Drawing Sheets

UNIVERSAL ADAPTOR AND METHODS FOR INSTALLING FENESTRATION PRODUCTS

This application claims priority to U.S. Ser. No. 61/838,471, entitled UNIVERSAL ADAPTER AND METHODS FOR INSTALLING WINDOWS AND THE LIKE filed Jun. 24, 2013, which is incorporated herein by reference.

I. BACKGROUND

A. Field of the Invention

This invention applies generally to apparatuses and methods related to the installation of fenestration products, such as windows and the like, into structures.

B. Description of Related Art

FIG. 1 illustrates an outside view of a portion of a new construction structure 10 having an opening 12, defined by periphery 44, into which a fenestration product is to be installed. FIG. 2 illustrates a particular fenestration product, a known new construction window 14, which may be installed into the structure 10. The window 14 comprises one or more window panes 16 mounted to a frame 18. Around the outer perimeter of the frame 18 is a mounting flange 20. When installing the window 14 into the opening 12, the mounting flange 20 is nailed (or otherwise connected) to the surface 22 of the structure 10 near the opening 12. FIG. 3 shows window 14 installed into the opening in structure 10. After the window-14 has been installed, it is known, as shown in FIG. 4, to add siding panels 24, which may be made of any suitable material such as wood, metal, vinyl, etc., to the structure 10. Typically, the siding panels 24 cover the mounting flange 20, as shown.

FIG. 5 is a view from vantage point A1 in FIG. 1, a view of a side portion of the periphery 44 defining opening 12. Periphery 44 from view A1 comprises jamb 50 and cutout area 52. Cutout area 52 extends inwardly (into the structure 10) and thus defines contact surface 54 which forms a side of the jamb 50. The cutout area 52 has a width W1. FIG. 6 is a view from vantage point A2 in FIG. 1, a view of the bottom portion of the periphery 44 defining opening 12. Periphery 44 from view A2 comprises sill 56 and cutout area 58. Cutout area 58 extends inwardly (into the structure 10) and thus defines contact surface 60 which forms a side of sill 56. The cutout area 58 has a width W2. Typically cutout areas 52 and 58 extend inwardly the same amount, i.e., have the same depth, and typically W2 equals W1.

FIG. 7 shows a cross-section through the side portion of frame 18 of window 14. When installed, contact surface 62 abuts/contacts contact surface 54 (see FIG. 5) of the jamb 50, contact surface 46 abuts/contacts the surface of cutout area 52 (see FIG. 5) and contact surface 64 of mounting flange 20 abuts/contacts surface 22 (see FIG. 1) of the structure 10. The distance D1 between contact surface 62 and contact surface 64 is generally equal to (or very nearly equal to) width W1 (see FIG. 6). The bottom, top and other side of window 14 have similar contact surfaces and dimensions to properly fit into opening 12 (see FIG. 1) of structure 10. The window 14 may also have one or more channels 26 which serve to support window panes, air pockets or to serve other purposes known to those of skill in the art.

FIG. 8 shows a cross-section through the side portion of a frame 30 of another known fenestration product, window 28. Window 28 has many components that are the same as with window 14, so the same reference numbers are used. Unlike window 14, however, window 28 has an extension 32 that extends from the frame 30 in the same direction as the mounting flange 20 and substantially parallel to mounting flange 20. The space between the mounting flange 20 and the extension 32 defines a channel 34 referred to as an exterior panel receiver by those of skill in the art. The exterior panel receiver 34 serves the purpose of receiving the ends or sides of the siding panels (such as siding panels 24, shown in FIG. 4).

The installation of fenestration products as described in the previous paragraphs generally works well for new construction. There are problems, however, when the original (or previously) installed fenestration product needs to be replaced. FIG. 9 shows, for example, a cross-section through the side portion of a frame 38 of a known replacement window 36. As with the previous window described above, window 36 has a contact surface 46 that contacts the periphery 44 defining opening 12 (see FIG. 1) and one or more channels 26. Window 36 does not have, however, a mounting flange. Note generally planar outside surface 48. Width W3 is defined as the distance between one end of the outside surface 48 (shown on the right in FIG. 9) and a line along contact surface 46. The purpose for outside surface 48 and width W3 will be discussed below. Window 36 does not have an exterior panel receiver but some known replacement windows do have an exterior panel receiver.

When a fenestration product needs to be replaced, it first has to be removed. There are different methods for removing fenestration products. With reference to FIGS. 3 and 4, one method involves the removal of the siding panels 24, or at least the portions of the siding panels 24 that cover the mounting flange 20. Once the fenestration product, such as window 14, to be replaced is removed, including its mounting flange 20, the replacement window is then installed. In this case, the replacement window may have a mounting flange 20 and can be installed in a manner similar to the methods described above regarding new construction windows. The siding panels 24 must then be reinstalled or replaced with new siding panels. While this method generally provides high quality results, it is also very labor intensive and may require new siding panels. As a result, this method is very expensive.

A known lower cost method of replacing fenestration products such as windows, again with reference to FIGS. 3 and 4, is to cut through the mounting flange 20 via the crack 40 between the window frame 18 and the edges of the siding panels 24 next to the window 14. Once the mounting flange 20 is cut through, the original (or previous) window can be removed, revealing the opening 12 in the structure 10, as shown in FIG. 10. A replacement fenestration product, such as window 36 shown in FIG. 9, can then be inserted into the opening 12. This is shown in FIG. 11. Note that the replacement window cannot have a mounting flange as there is insufficient room to use one. While this method is a lower cost method, it is also a lower quality method. Note in particular that there is an opening or crack 42 between the outer perimeter of the frame 38 and the structure 10 defining opening 12. This opening or crack 42 is typically filled with a caulking, sealant or bonding compound in an effort to seal the opening or crack 42. However, the use of a caulking, sealant or bonding compound, or any know substance(s), between a fenestration product 36 and the structure 10 to which it is installed is known to provide only a short term seal. Over time, especially with changing temperatures that come with changing seasons, such "seals" are known to deteriorate. As a result, outside air will eventually enter the structure 10 via the opening or crack 42 (and/or inside air will leave the structure via the opening or crack 42) greatly reducing the energy efficiency of the fenestration product.

Perhaps even worse, moisture will eventually penetrate the opening or crack 42 and damage the structure 10 itself.

What are needed are apparatuses and methods that make window replacement easy, inexpensive, and of high quality, thereby overcoming the problems described above.

II. SUMMARY

According to some embodiments of this invention, a method may comprise the steps of: (A) providing a structure comprising a structure opening that is defined by a periphery having first and second portions; (B) providing a first fenestration product comprising dimensions such that the first fenestration product can be received within the structure opening; (C) providing a universal adaptor comprising: a first adaptor piece sized to be received on the first portion of the structure opening periphery and a second adaptor piece sized to be received on the second portion of the structure opening periphery; wherein each of the first and second adaptor pieces comprises: (1) a longitudinal length defining first and second ends; and, (2) a cross-sectional shape comprising: (a) a laterally extending main wall having a proximal end and a distal end; and, (b) a support wall that extends laterally from the main wall; (D) attaching the first adaptor piece to the first portion of the periphery by: (1) inserting the proximal end of the main wall of the first adaptor piece into the structure opening juxtaposed to the first portion of the structure opening; and, (2) attaching the proximal end of the main wall of the first adaptor piece to the structure; wherein after the first adaptor piece has been attached to the first portion of the periphery, the support wall of the first adaptor piece extends into the structure opening; (E) attaching the second adaptor piece to the second portion of the periphery by: (1) inserting the proximal end of the main wall of the second adaptor piece into the structure opening juxtaposed to the second portion of the structure opening; and, (2) attaching the proximal end of the main wall of the second adaptor piece to the structure; wherein after the second adaptor piece has been attached to the second portion of the periphery the support wall of the second adaptor piece extends into the structure opening; (F) inserting the first fenestration product into the structure opening until a first surface of the first fenestration product abuts/contacts the support wall of the first adaptor piece and a second surface of the first fenestration product abuts/contacts the support wall of the second adaptor piece; and, (G) securing the first fenestration product to the structure.

According to other embodiments of this invention, the method may include: step (A) comprises the step of: providing the structure to be located at a site; and, step (C) comprises the step of: cutting a single component to make the first and second adaptor pieces at the site.

According to other embodiments of this invention, the method may include: prior to step (A) the method comprises the step of: removing a second fenestration product, that comprises a mounting flange that extends outside the opening and is attached to the structure, from the structure opening by: (a) cutting the mounting flange juxtaposed to the structure opening; and, (b) moving the second fenestration product away from the structure.

According to other embodiments of this invention, the method may include: step (A) comprises the step of: providing the structure with a first siding panel positioned on the structure next to the structure opening; step (C) comprises the step of: providing the first adaptor piece with a first receiver wall that extends laterally from the main wall; and, the method further comprises the step of: positioning at least a portion of the first siding panel that is positioned on the structure next to the structure opening between the first receiver wall and the structure.

According to other embodiments of this invention, the method may include: step (C) comprises the step of: providing the first adaptor piece with a second receiver wall that extends laterally from the main wall; and, step (D) (1) comprises the step of: (1) inserting the proximal end of the main wall of the first adaptor piece into the structure opening juxtaposed to the first portion of the structure opening until the second receiver wall abuts/contacts the mounting flange of the second fenestration product remaining on the structure.

According to other embodiments of this invention, the method may include: step (C) comprises the step of: providing the first adaptor piece with first and second receiver walls that extend laterally from the main wall; and, trimming at least one of the first receiver wall, the second receiver wall and the support wall of the first adaptor piece to fit the first fenestration product.

According to other embodiments of this invention, the method may include: step (A) comprises the step of: providing the first periphery portion to contact the second periphery portion at a corner; step (C) comprises the steps of: providing the first end of the first adaptor piece with a cutout section that enables the first end of the first adaptor piece to extend beyond the corner a distance FA1; and, providing the first end of the second adaptor piece with a cutout section that enables the first end of the second adaptor piece to extend beyond the corner a distance SA1; and, before step (F) the method comprises the steps of: receiving a portion of the first end of the second adaptor piece within the cutout section of the first adapter piece juxtaposed to the corner and outside the structure opening; and, receiving a portion of the first end of the first adaptor piece within the cutout section of the second adapter piece juxtaposed to the corner and outside the structure opening.

According to other embodiments of this invention, the method may include: step (A) comprises the step of: providing the first periphery portion to have a length LPP1 and the second periphery portion to have a length LPP2; and, step (C) comprises the steps of: providing the longitudinal length of the first adaptor piece to be at least LPP1+FA1; and, providing the longitudinal length of the second adaptor piece to be at least LPP2+SA1.

According to other embodiments of this invention, the method may include: step (A) comprises the steps of: providing the structure opening to be rectangular in shape; providing: the first periphery portion to be a first side of the rectangular structure opening; the second periphery portion to be a second side of the rectangular structure opening that contacts the first periphery portion at a first corner; a third periphery portion to be a third side of the rectangular structure opening that contacts the second periphery portion at a second corner; a fourth periphery portion to be a fourth side of the rectangular structure opening that contacts the third periphery portion at a third corner and contacts the first periphery portion at a fourth corner; step (C) comprises the step of: providing the universal adaptor to comprise: a third adaptor piece sized to be received on the third portion of the structure opening periphery and a fourth adaptor piece sized to be received on the fourth portion of the structure opening periphery; wherein each of the third and fourth adaptor pieces comprises: (1) a longitudinal length defining first and second ends; and, (2) a cross-sectional shape comprising: (a) a laterally extending main wall having a proximal end and a distal end; and, (b) a support wall that extends laterally from the main wall; the method further comprises the step of attaching the third adaptor piece to the third portion of the periphery by: (1) inserting the proximal end of the main wall of the third adaptor piece into the structure opening juxtaposed to the third portion of the structure opening; and, (2) attaching the proximal end of the main wall of the third adaptor piece to the structure; wherein after the third adaptor piece has been attached to the third portion of the periphery the support wall of the third adaptor piece extends into the structure opening; the method further comprises the step of attaching the fourth adaptor piece to the fourth portion of the periphery by: (1) inserting the proximal end of the main wall of the fourth adaptor piece into the structure opening juxtaposed to the fourth portion of the structure opening; and, (2) attaching the proximal end of the main wall of the fourth adaptor piece to the structure; wherein after the fourth adaptor piece has been attached to the fourth portion of the periphery the support wall of the fourth adaptor piece extends into the structure opening; and, step (F) comprises the step of inserting the first fenestration product into the structure opening until a third surface of the first fenestration product abuts/contacts the support wall of the third adaptor piece and a fourth surface of the first fenestration product abuts/contacts the support wall of the fourth adaptor piece.

According to other embodiments of this invention, the method may include: step (C) comprises the steps of: providing the first end of the first adaptor piece with a cutout section that enables the first end of the first adaptor piece to extend beyond the first corner; providing the second end of the first adaptor piece with a cutout section that enables the second end of the first adaptor piece to extend beyond the fourth corner; providing the first end of the second adaptor piece with a cutout section that enables the first end of the second adaptor piece to extend beyond the first corner; providing the second end of the second adaptor piece with a cutout section that enables the second end of the second adaptor piece to extend beyond the second corner; providing the first end of the third adaptor piece with a cutout section that enables the first end of the third adaptor piece to extend beyond the second corner; providing the second end of the third adaptor piece with a cutout section that enables the second end of the third adaptor piece to extend beyond the third corner; providing the first end of the fourth adaptor piece with a cutout section that enables the first end of the fourth adaptor piece to extend beyond the third corner; providing the second end of the fourth adaptor piece with a cutout section that enables the second end of the fourth adaptor piece to extend beyond the fourth corner; and, before step (F) the method comprises the steps of: receiving a portion of the first end of the first adaptor piece within the first end cutout section of the second adapter piece juxtaposed to the first corner and outside the structure opening; receiving a portion of the second end of the first adaptor piece within the second end cutout section of the fourth adapter piece juxtaposed to the fourth corner and outside the structure opening; receiving a portion of the first end of the second adaptor piece within the first end cutout section of the first adapter piece juxtaposed to the first corner and outside the structure opening; receiving a portion of the second end of the second adaptor piece within the first end cutout section of the third adapter piece juxtaposed to the second corner and outside the structure opening; receiving a portion of the first end of the third adaptor piece within the second end cutout section of the second adapter piece juxtaposed to the second corner and outside the structure opening; receiving a portion of the second end of the third adaptor piece within the first end cutout section of the fourth adapter piece juxtaposed to the third corner and outside the structure opening; receiving a portion of the first end of the fourth adaptor piece within the second end cutout section of the third adapter piece juxtaposed to the third corner and outside the structure opening; and, receiving a portion of the second end of the fourth adaptor piece within the second end cutout section of the first adapter piece juxtaposed to the fourth corner and outside the structure opening.

According to other embodiments of this invention, the method may include: providing a trim piece that: (1) is colored to match at least one of the structure and the first fenestration product; and, (2) comprises a pair of fingers; cutting the trim piece to have a suitable longitudinal length; and, attaching the trim piece to the first adaptor piece juxtaposed to the structure opening by positioning a portion of the first adaptor piece between the pair of fingers.

According to other embodiments of this invention, a universal adaptor for use with: (A) an associated structure comprising a structure opening that is defined by a periphery having first and second portions; and, (B) an associated fenestration product comprising dimensions such that the associated fenestration product can be received within the structure opening; the universal adaptor comprising: a first adaptor piece sized to be received on the first portion of the structure opening periphery; a second adaptor piece sized to be received on the second portion of the structure opening periphery; wherein each of the first and second adaptor pieces comprises: (1) a longitudinal length defining first and second ends; and, (2) a cross-sectional shape comprising: (a) a laterally extending main wall having a proximal end and a distal end; and, (b) a support wall that extends laterally from the main wall; wherein the first adaptor piece is attachable to the first portion of the periphery by: (1) inserting the proximal end of the main wall of the first adaptor piece into the structure opening juxtaposed to the first portion of the structure opening; and, (2) attaching the proximal end of the first adaptor piece to the structure; wherein the first adaptor is sized and shaped so that after it has been attached to the first portion of the periphery: (1) the support wall of the first adaptor piece extends into the structure opening; and, (2) when the associated fenestration product is inserted into the structure opening, a first surface of the associated fenestration product abuts/contacts the support wall of the first adaptor piece; wherein the second adaptor piece is attachable to the second portion of the periphery by: (1) inserting the proximal end of the main wall of the second adaptor piece into the structure opening juxtaposed to the second portion of the structure opening; and, (2) attaching the proximal end of the second adaptor piece to the structure; and, wherein the second adaptor is sized and shaped so that after it has been attached to the second portion of the periphery: (1) the support wall of the second adaptor piece extends into the structure opening; and, (2) when the associated fenestration product is inserted into the structure opening, a second surface of the associated fenestration product abuts/contacts the support wall of the second adaptor piece.

According to other embodiments of this invention, for both of the first and second adaptor pieces: the main wall is planar; the support wall is planar; and, the support wall extends substantially at a right angle with respect to the main wall.

According to other embodiments of this invention, for at least the first adaptor piece: the main wall is planar; the support wall is planar; a first receiver wall that is planar extends laterally from the main wall; a second receiver wall that is planar extends laterally from the main wall; and, the second receiver wall is sized and positioned so that when: (1) the first adaptor is attached to the first portion of the periphery; and, (2) the associated structure comprises a first siding panel positioned on the structure next to the structure opening; at least a portion of the first siding panel is positioned between the second receiver wall and the structure.

According to other embodiments of this invention, for at least the first adaptor piece: a distal end of the first receiver wall comprises a beveled edge; and, a distal end of the second receiver wall comprises a leading edge having a curved outer surface.

According to other embodiments of this invention, for at least the first adaptor piece: the support wall extends from a first side of the main wall; the first receiver wall extends from a second side of the main wall; and, the second receiver wall extends from the second side of the main wall.

According to other embodiments of this invention, it may further comprise: first and second trim pieces that each comprises a pair of fingers; wherein the first trim piece is attached to the first adaptor piece juxtaposed to the structure opening by positioning a portion of the first adaptor piece between the pair of fingers of the first trim piece; and, wherein the second trim piece is attached to the second adaptor piece juxtaposed to the structure opening by positioning a portion of the second adaptor piece between the pair of fingers of the second trim piece.

According to other embodiments of this invention, the first and second adaptor pieces are formed by cutting a single component.

According to other embodiments of this invention, the first periphery portion contacts the second periphery portion at a corner; the first end of the first adaptor piece comprises a cutout section that enables the first end of the first adaptor piece to extend beyond the corner a distance FA1 when the first adaptor piece is attached to the first portion of the periphery; the first end of the second adaptor piece comprises a cutout section that enables the first end of the second adaptor piece to extend beyond the corner a distance SA1 when the second adaptor piece is attached to the second portion of the periphery; when the first and second adaptor pieces are attached to the first and second portions of the periphery, respectively: (1) a portion of the first end of the second adaptor piece is received with the cutout section of the first adaptor piece; and, (2) a portion of the first end of the first adaptor piece is received with the cutout section of the second adaptor piece.

According to other embodiments of this invention, the first periphery portion has a length LPP1; the second periphery portion has a length LPP2; the longitudinal length of the first adaptor piece is at least LPP1+FA1; and, the longitudinal length of the second adaptor piece is at least LPP2+SA1.

According to other embodiments of this invention, it may further comprise: a tool that is: (1) used to form the cutout section in the first end of the first adaptor piece; (2) used to form the cutout section in the first end of the second adaptor piece; and, (3) easily carried by a single typical man.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 12:
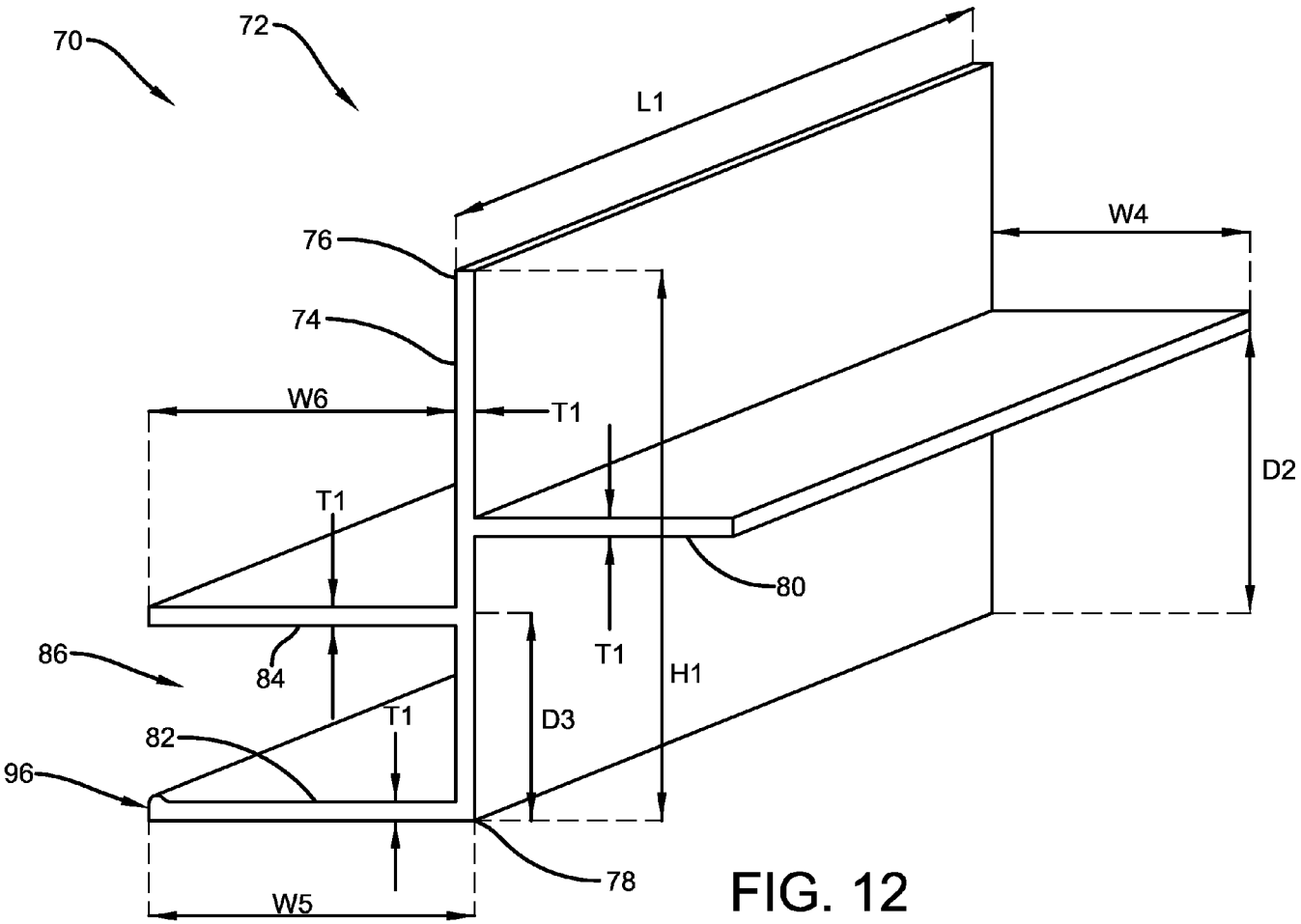
FIG. 12 is a perspective end view of a component that can be modified to make a universal adaptor according to some embodiments of this invention.

Referring now to the drawings wherein the showings are for purposes of illustrating embodiments of the invention only and not for purposes of limiting the same, and wherein like reference numerals are understood to refer to like components, FIG. 12 shows a component 70 that can be modified to make a universal adaptor 72 according to embodiments of this invention. The universal adaptor 72 (shown, for example, in FIG. 12) can be positioned between a structure (such as structure 10 described above) and a replacement fenestration product (such as replacement window 36 shown in FIG. 9). It should be noted, however, that while the universal adaptor 72 of this invention is especially adapted for use with replacement window, it is not limited to that application. It can also be used to install new construction windows, doors, and any other fenestration product chosen with the sound judgment of a person of skill in the art. The component 70, and thus universal adaptor 72, can be made of any material chosen with the sound judgment of a person of skill in the art. In one embodiment, the component 70, and thus universal adaptor 72, can be made of vinyl. The universal adaptor 72 may include as many pieces as there are portions of the periphery that define the opening into which a fenestration product is to be attached. In some embodiments the periphery portions are linear sides but that is not a requirement for this invention. The periphery portions may be, in another embodiment, curved surfaces. In some embodiments discussed below, the opening has a rectangular periphery with four portions and thus the adaptor may include four pieces; one that attaches to the top portion of the periphery, another that attaches to one side portion of the periphery, another that attaches to the other side portion of the periphery and another that attaches to the bottom portion of the periphery of the opening. However, the universal adaptor 72 of this invention can be used with openings having peripheries of any size chosen with the sound judgment of a person of skill in the art. Non-limiting opening shapes that will work with this invention include any number of sides, thus any polygons, and shapes including curved walls.

With reference now to FIG. 12, component 70 may have a longitudinal length L1 that can be of any specific length as required. The component 70 may be cut along its longitudinal length to make the pieces that define the universal adaptor 72 for any specific application. The component 70, and thus the universal adaptor 72, may have a cross-sectional shape that includes a main wall 74 having a proximal end 76 (toward the inside of the structure once installed) and a distal end 78 (away from the inside of the structure once installed). Main wall 74 may be planar, as shown, and may have a height H1. Extending from main wall 74 on one side may be support wall 80. Support wall 80 may be planar, as shown, and may extend at a substantially right angle from main wall 74. Support wall 80 may have a width W4 and may be spaced from the distal end 78 of the main wall 74 a distance D2. Extending from the other side of the main wall 74 may be first receiver wall 82. First receiver wall 82 may be planar, as shown, and may extend at a substantially right angle from main wall 74. First receiver wall 82 may have a width W5 and may extend from the distal end 78 of the main wall 74, as shown. Also extending from the other side of the main wall 74 may be second receiver wall 84. Second receiver wall 84 may be planar, as shown, and may extend at a substantially right angle from main wall 74. Second receiver wall 84 may have a width W6 and may be spaced from the distal end 78 of the main wall 74 a distance D3. The walls may have a common thickness T1. In one embodiment an outer end of first receiver wall 82 may extend proximally and have a curved outer surface 96, as shown. The curved outer surface 96 may form a leading edge used when the universal adaptor 72 is inserted during installation. It should be understood that the curved surface is just one shape that may be used with this invention. Any shape or configuration that would serve as an aid to the installation techniques may be used with this invention.

With continuing reference to FIG. 12, the dimensions H1, W4, D2, W5, W6, D3 and T1, can be any chosen with the sound judgment of a person of skill in the art. It has been determined, however, that the following dimensions are suitable for many applications: H1 is about 2.50 inches; W4 is about 1.25 inches; D2 is about 1.25 inches; W5 and W6 are about 1.50 inches; D3 is about 0.75 inches; and, T1 is about 0.06 inches. Thus, W5 may in some embodiments equal (though it may not in other embodiments) W6 and support wall 80 may be positioned some distance between the proximal and distal ends 76, 78 of the main wall 74. D3, the distance between first receiver wall 82 and second receiver walls 84, may be about the same size as is typical when forming an exterior panel receiver. In fact, the space between first and second receiver walls 82 and 84 can serve as an exterior panel receiver 86, as will be discussed further below.

Figure 5:
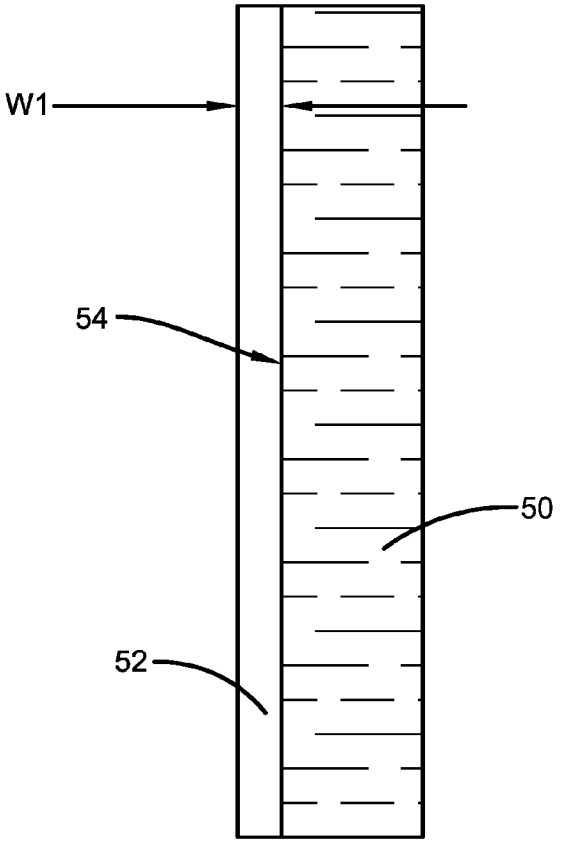
FIG. 5 PRIOR ART
FIG. 5 is a view from vantage point A1 in FIG. 1.
Figure 6:
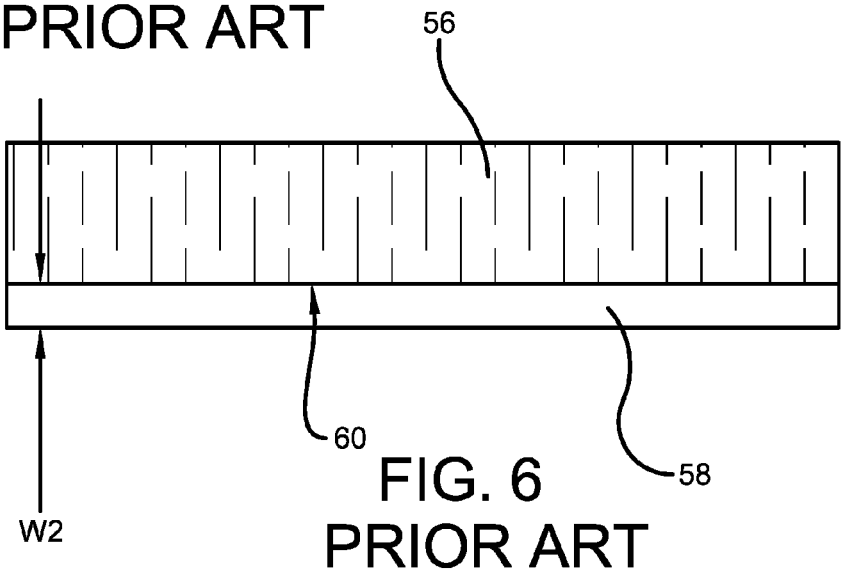
FIG. 6 PRIOR ART
FIG. 6 is a view from vantage point A2 in FIG. 1.
Figure 7:
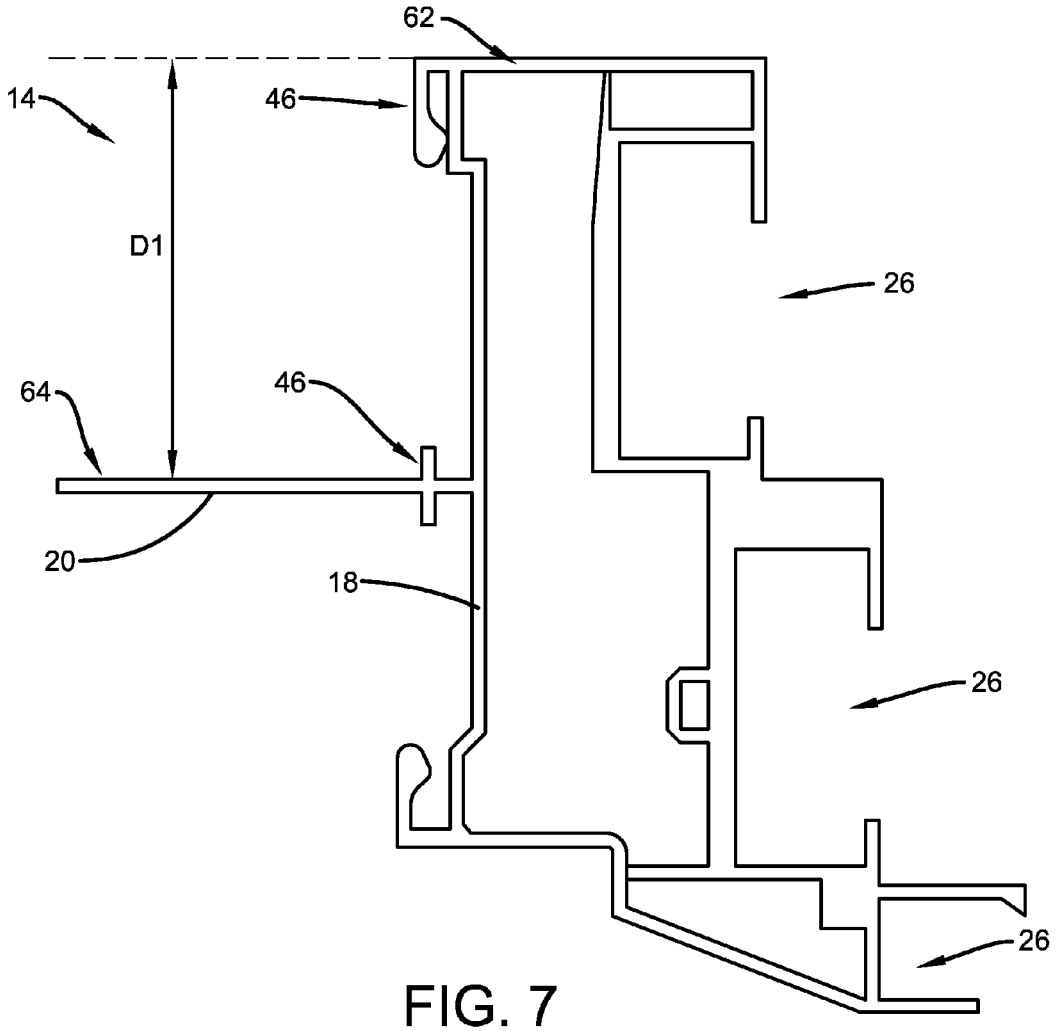
FIG. 7 PRIOR ART
FIG. 7 is a cross-sectional view of a known window.
Figure 8:
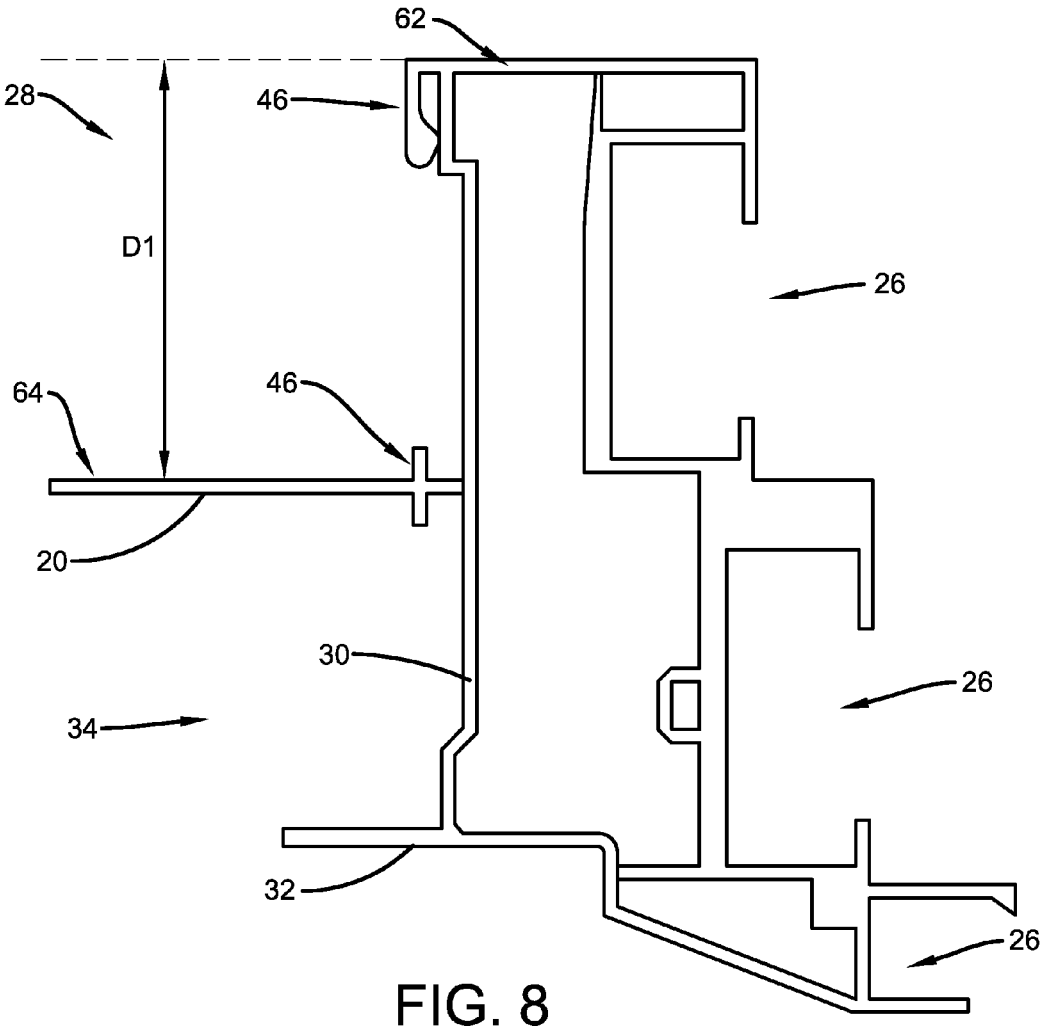
FIG. 8 PRIOR ART
FIG. 8 is a cross-sectional view of a known window having an exterior panel receiver.
Figure 13:
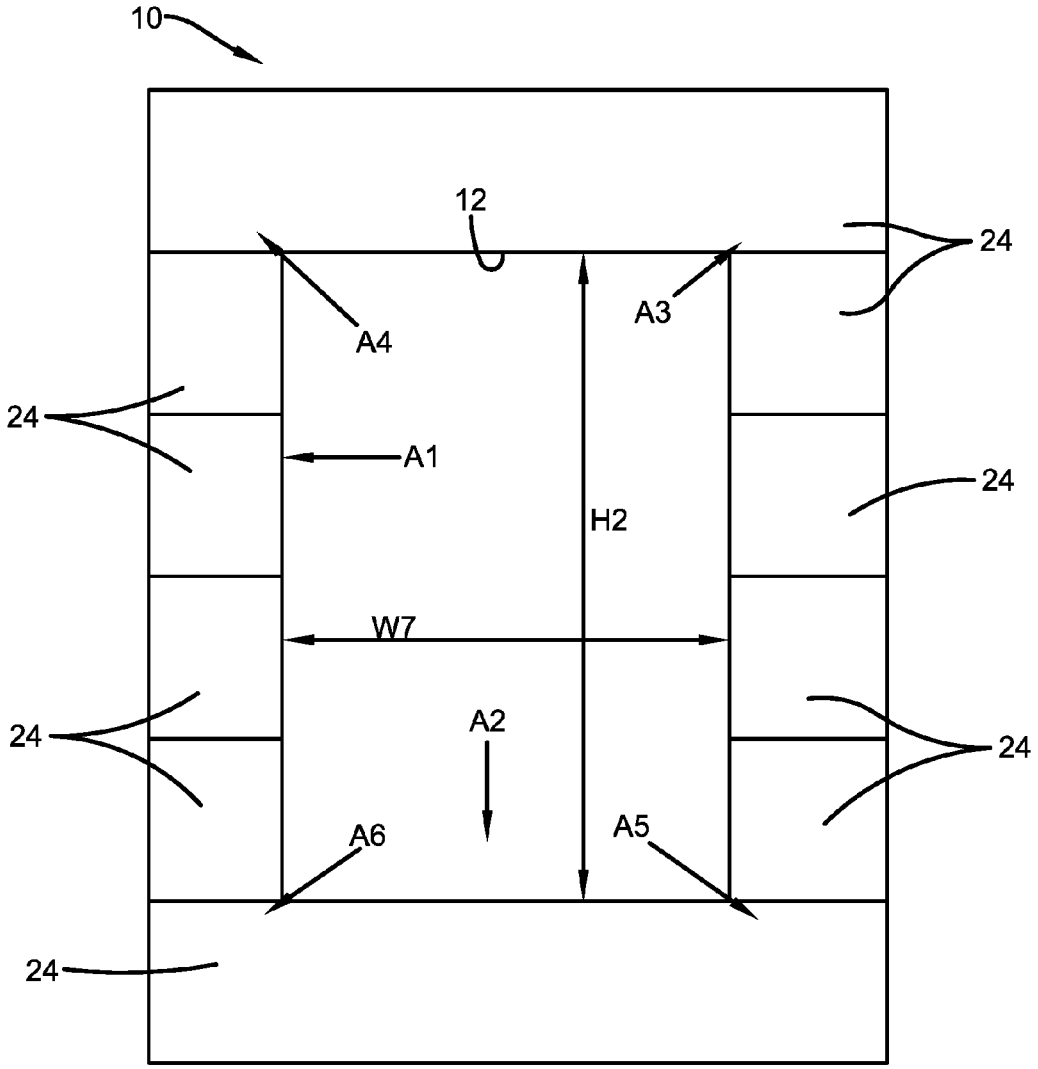
FIG. 13 is an outside view of a structure where the original (or previous) fenestration product has been removed.
Figure 14:
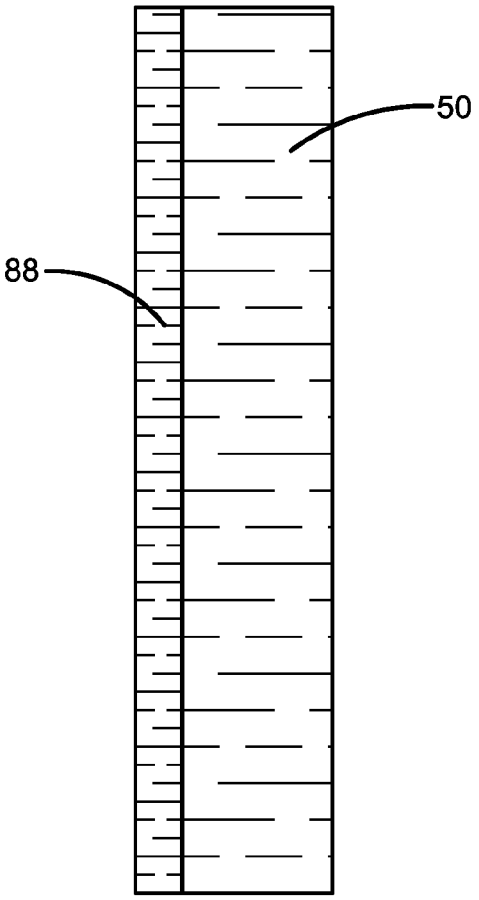
FIG. 14 is a view similar to that shown in FIG. 5 but with the cutout area filled.
Figure 15:
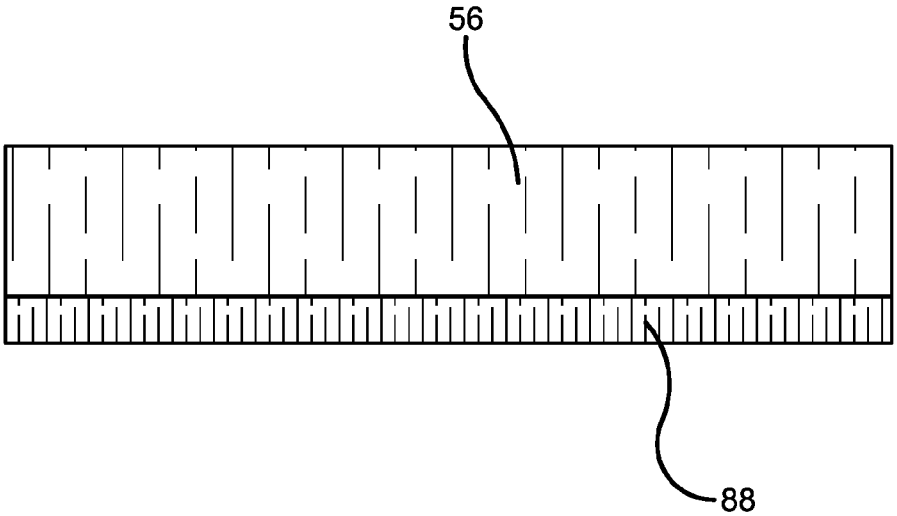
FIG. 15 is a view similar to that shown in FIG. 6 but with the cutout area filled.

The use of the component 70 to make a universal adaptor 72 for a specific use according to one embodiment will now be described. FIG. 13 shows a structure 10 where the original (or previous) fenestration product has been removed without removing the exterior siding panels 24 (though the edges near opening 12 may be pulled back slightly). If the surfaces of the structure defining the opening 12 include cutouts areas (such as cutout areas 52 and 60 shown in FIGS. 5 and 6), the cutout areas may be filled. As shown in FIGS. 14 and 15, for example, the cutout areas may be filed with filler objects 88 which may be, for one non-limiting example, pieces of wood. In this way the outer surface of objects 88 are coplanar with the outer surface of the jamb 50 and the sill 56, providing a flat surface onto which a replacement fenestration product can be installed.

Figure 16:
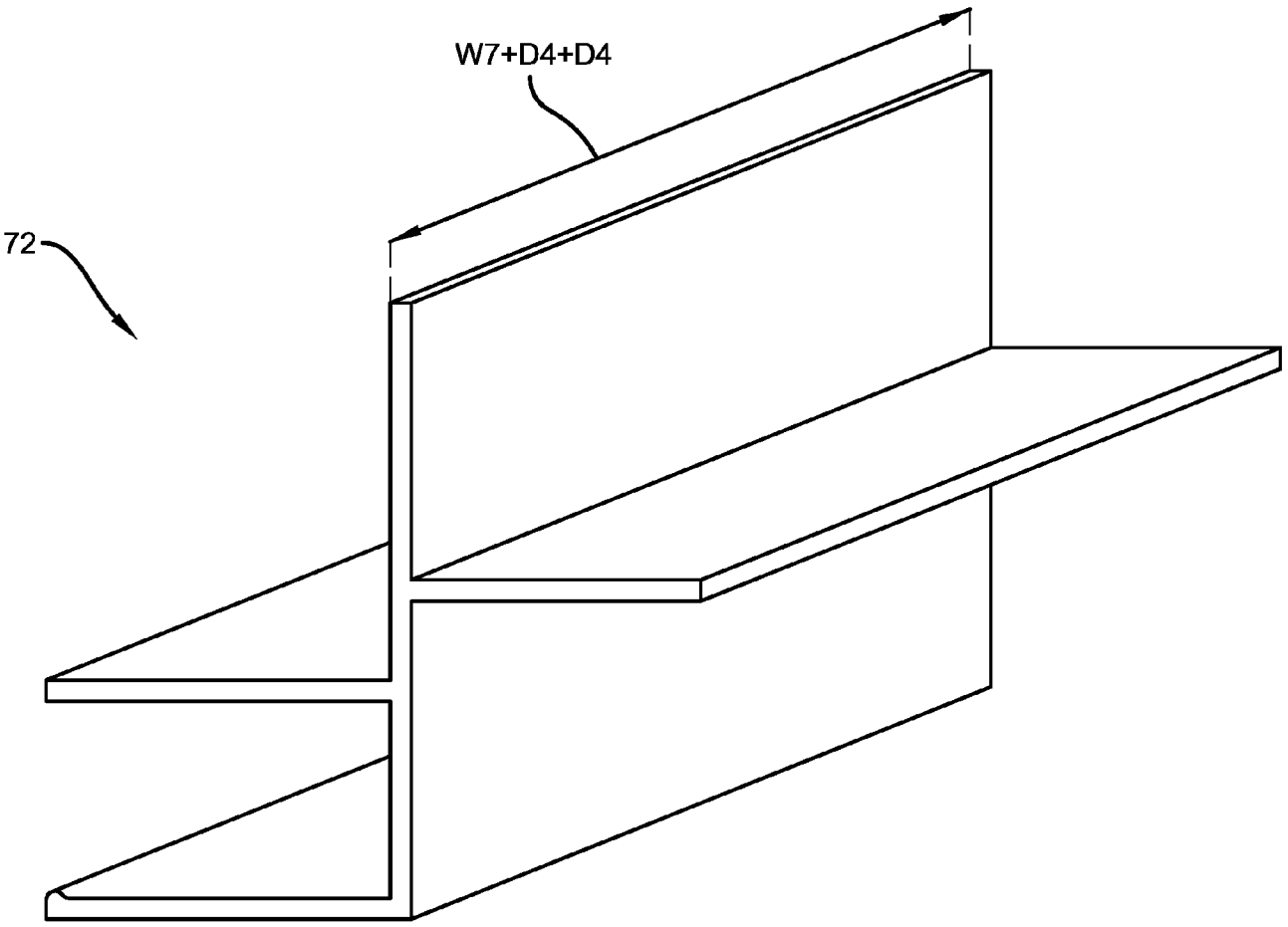
FIG. 16 is a perspective end view showing the cross-sectional shape of a universal adaptor according to some embodiments of this invention.

Referring again to FIG. 13, the height H2 and width W7 of opening 12 may be measured (if they are not already known). The component 70 may then be cut into a sufficient number of pieces that make up the universal adaptor 72. In one specific embodiment, the component 70 may be cut into four pieces that make up the universal adaptor 72; specifically: a first to attach to the bottom of the opening 12, a second to attach to the top, a third to attach to the left side and a fourth to attach to the right side of the opening 12. In order to create an appropriate overlap, each of the four pieces may be cut to a length greater than the height H2 or width W7 of the opening 12 where the piece will be used. FIG. 16, for example, shows a bottom piece of a universal adaptor 72 having a total length W7+D4+D4. As will become clear below, it is convenient to think of the bottom piece as having a length W7 plus an additional length D4 on each end. While the specific distance D4 may be any chosen with the sound judgment of a person of skill in the art, D4 of about 1.50 inches has been determined to be suitable for many applications. Thus, the total length of the bottom piece, as well as the top piece may be W7 plus 3.0 inches, in one embodiment. Similarly, each of the left side and right side pieces may be cut out of component 70 to have a length H2+D4+D4, or H2 plus 3.0 inches, in one embodiment.

Figure 17:
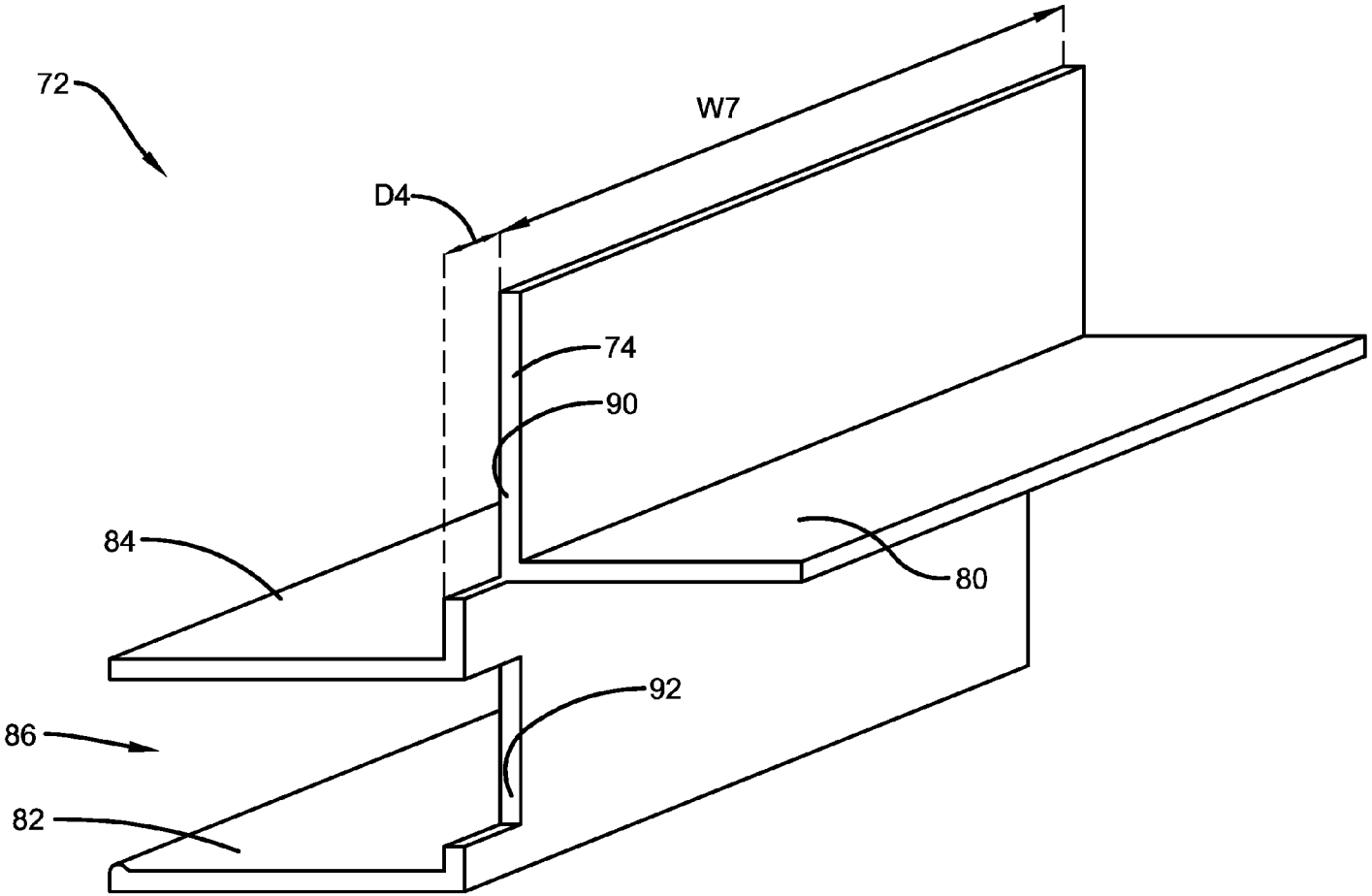
FIG. 17 is a view similar to that shown in FIG. 16 but showing cutout areas on one end of the universal adaptor.
Figure 18:
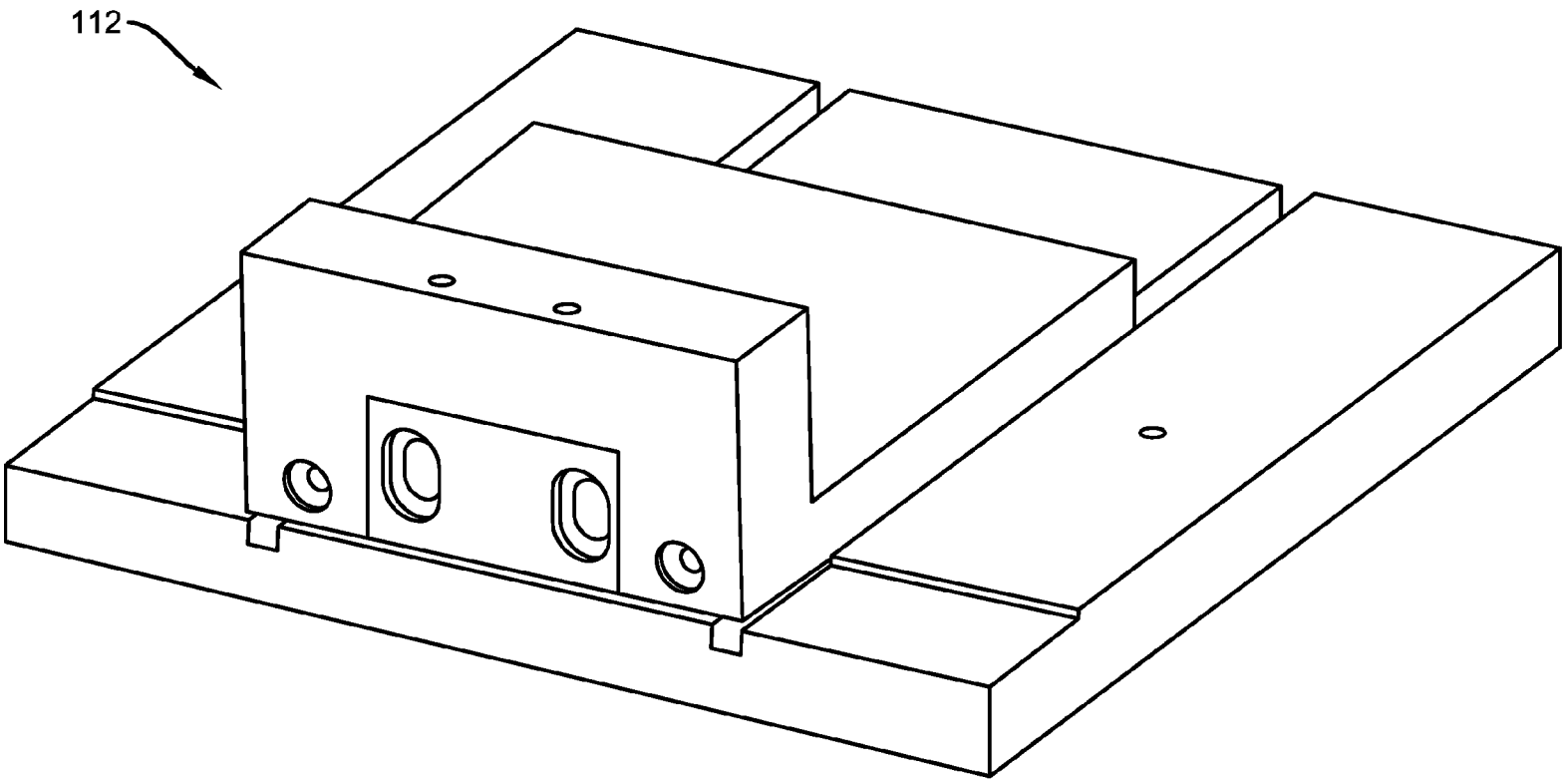
FIG. 18 is a perspective view of a tool used to make cuts on a universal adaptor according to some embodiments of this invention.

With reference now to FIG. 17, as well as FIGS. 13 and 16, once the bottom piece has been created by cutting out of component 70 a section having a length W7+D4+D4, portions of each end of the bottom piece may be removed. Specifically, at one end, a first cutout section 90 may be made on the proximal end of main wall 74 and a second cutout section 92 may be made between the first and second receiver walls 82, 84, as shown. Similar cutout sections are made on the opposite end of the piece (though they are not shown in FIG. 17). In one specific embodiment, each of the cutout sections 90, 92 extend into the piece the distance D4. As a result, the bottom piece has a mid-section along its length of length W7 to properly cover the bottom of the opening 12. Each end of the bottom piece has cutout sections 90, 92 that, when attached to the structure 10, extend outside of the opening 12, beyond the side edges of the opening 12. The top piece is similarly made, having total length W7+D4+D4 with cutouts 90, 92 on each end that, when the piece is attached to the structure, extend outside of the opening 12, beyond the side edges of the opening 12. The left side and right side pieces are similarly made but having a total length H1+D4+D4. They also have cutouts 90, 92 on each end that, when each piece is attached to the structure, extend outside the opening 12 above and below the opening 12.

Figure 22:
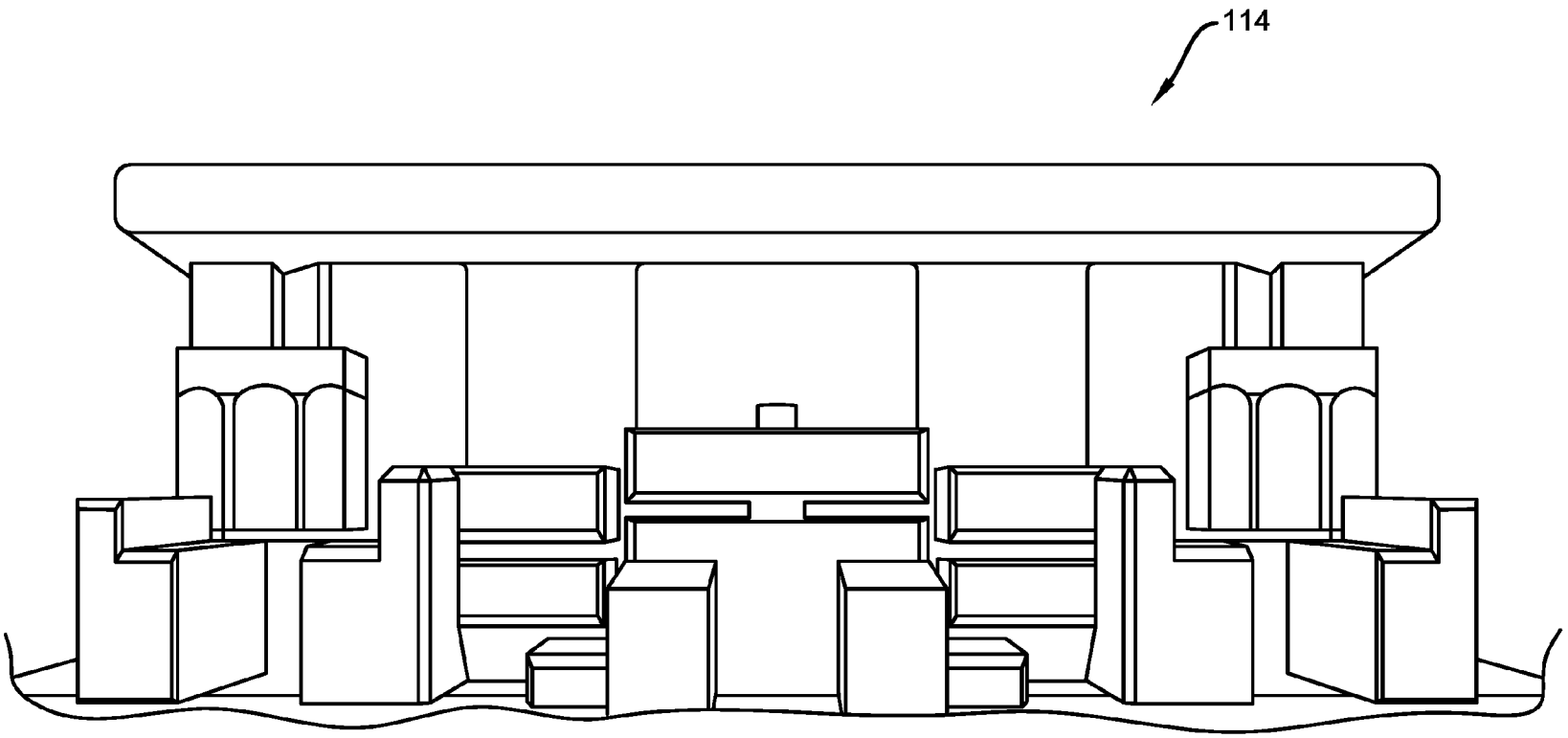
FIG. 22 is a front view of a die that may be used to make cutouts on the universal adaptor according to some embodiments of this invention.
Figure 23:
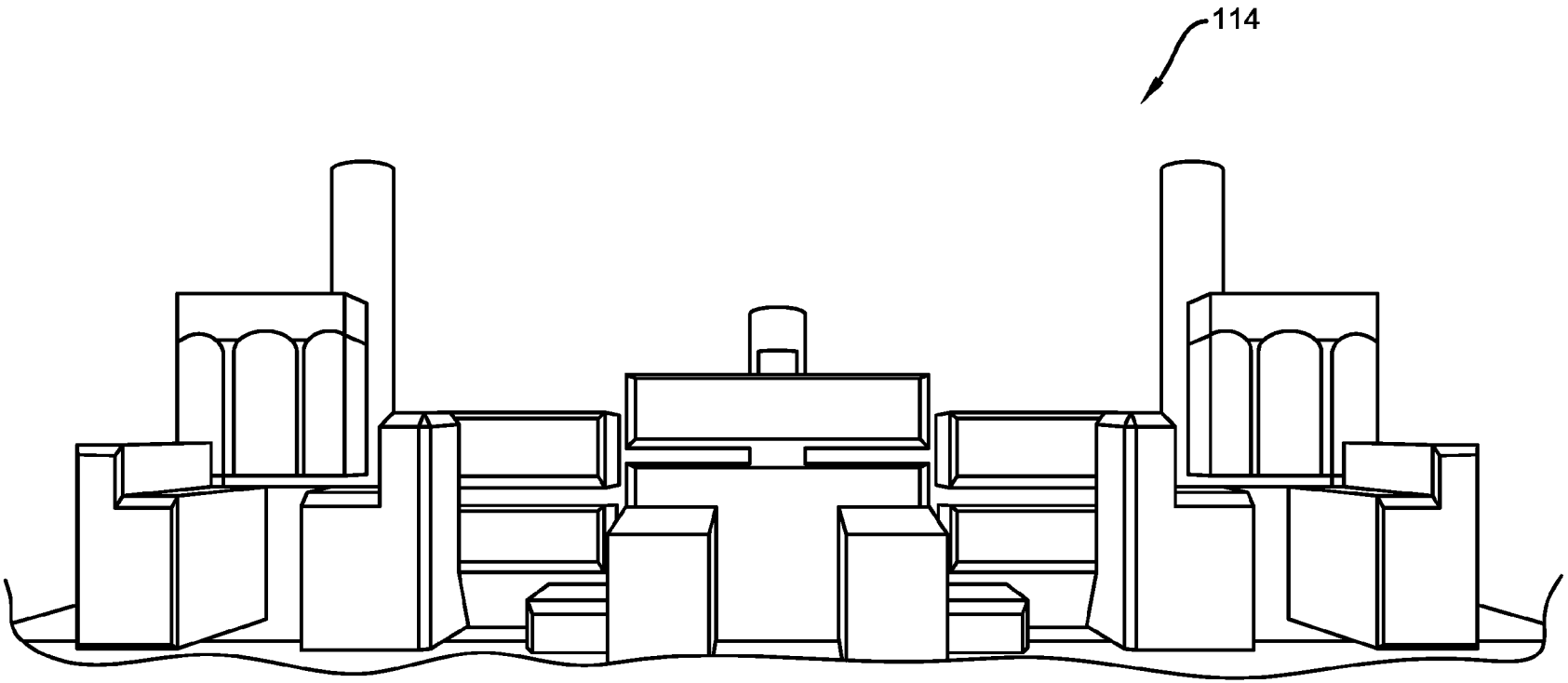
FIG. 23 is a view similar to that shown in FIG. 22 but with the top portion of the die removed.

With reference now to FIGS. 17 and 22-23, the cutouts 90, 92 may be made on site using a die 114 as shown in FIGS. 22-23 or any device capable of properly executed the designed notch dimensions. Specifically, each universal adaptor 72 piece may be placed into the die 114 and the die 114 may then be used in a known manner, such as using a pneumatic cylinder, to create the cutouts 90, 92.

Figure 13A:
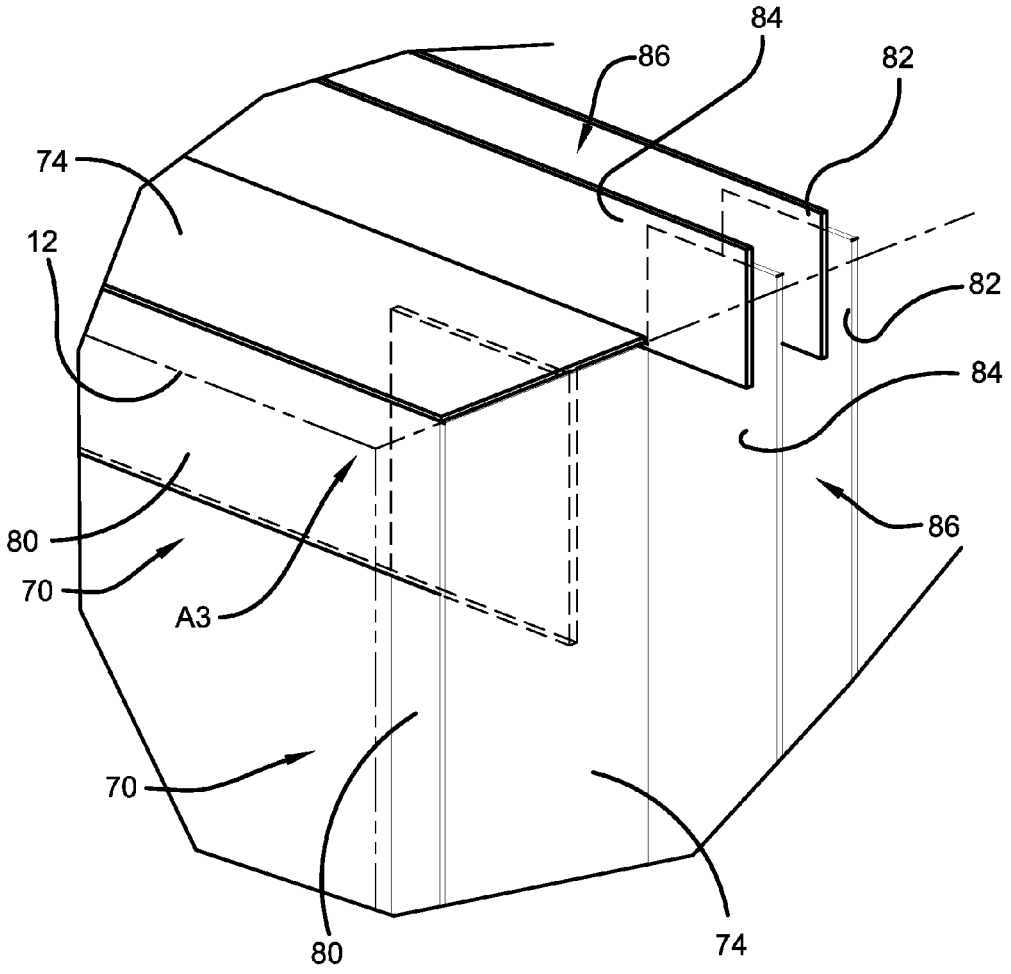
FIG. 13A shows how neighboring adaptors may interconnect.

With reference now to FIGS. 13, 16 and 17, because each of the pieces (four pieces in this embodiment) has two ends of distance D4 that extends outside and beyond the opening 12, they must, and do, engage each other. Specifically, the end of receiver wall 84 on one piece is received within cutout 92 of the neighboring piece. Note that these engagements are established outside and beyond the opening 12. Specifically, the right side of the top piece engages the top of the right side piece in area A3 shown in FIGS. 13 and 13A (beneath the siding panels 24). Similarly, the left side of the top piece engages the top of the left side piece in area A4, the right side of the bottom piece engages the bottom of the right side piece in area A5 and the left side of the bottom piece engages the bottom of the left side piece in area A6.

With reference now to FIGS. 9, 12, 17 and 18, the pieces of the universal adaptor 72 may be modified in one additional way before they are used. Specifically, the support wall 80 may be cut or trimmed to shorten its width from W4 (shown in FIG. 12) to width W3 (shown in FIG. 9) using a tool, such as tool 18 shown in FIG. 18. Specifically, each universal adaptor 72 piece may be placed on the tool 112. The tool 112 may then be adjusted (in or out as required) a predetermined distance so that a score line may be added. The distance is predetermined based on the fenestration product being used. If the fenestration product is a window, then the distance is predetermined based on the window type; non-limiting examples of window types include: double hung, slider, picture window, patio door and single hung windows. As known by those of skill in the art, the score line is a line where the thickness of the universal adaptor 72 has been reduced. As a result, the installer can easily remove the portion of the support wall 80 around the score line. The tool 112 may be used to make other score lines on the component 70 and universal adaptor 72 pieces as needed.

Figure 9:
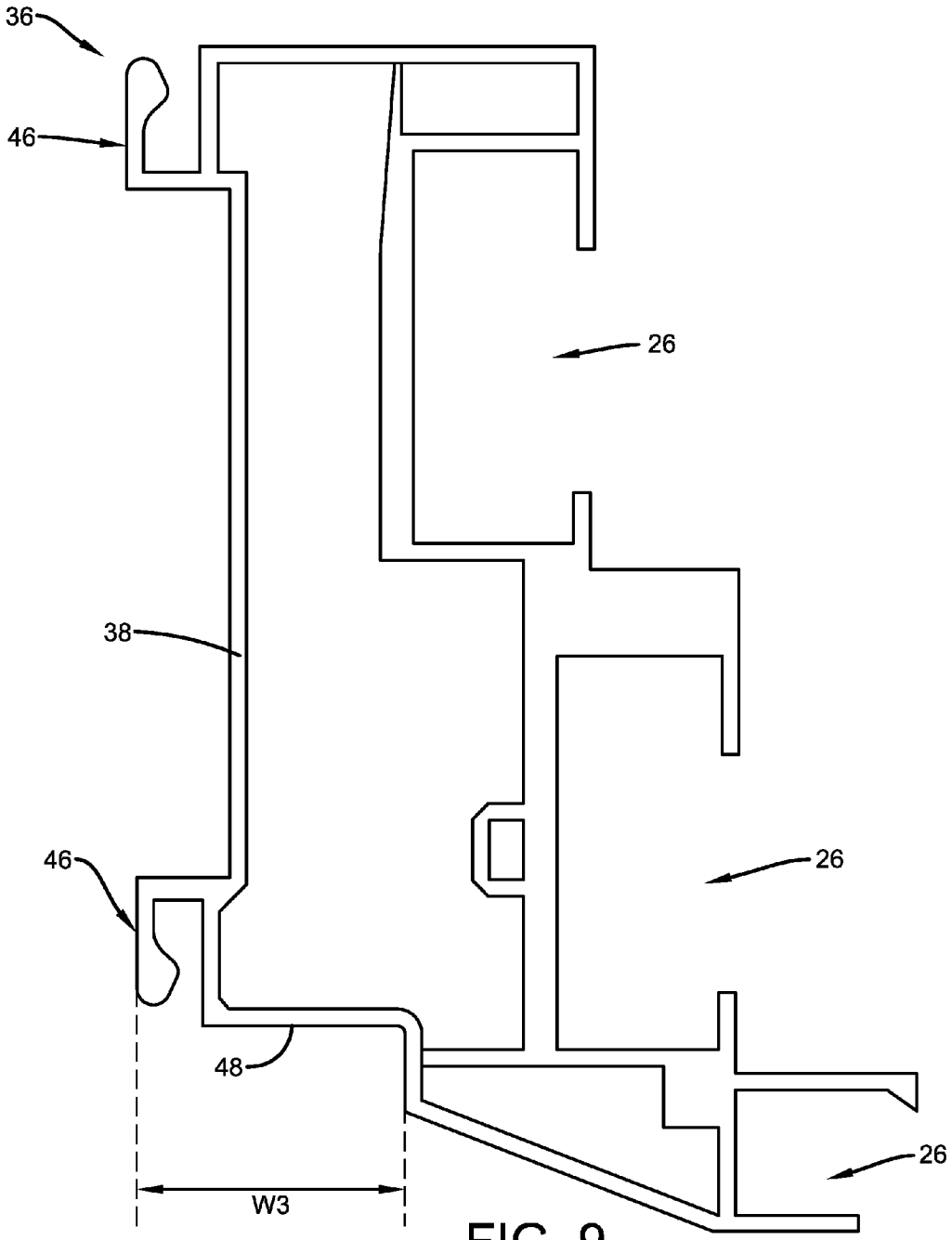
FIG. 9 PRIOR ART
FIG. 9 is cross-sectional view of a known replacement window.
Figure 10:
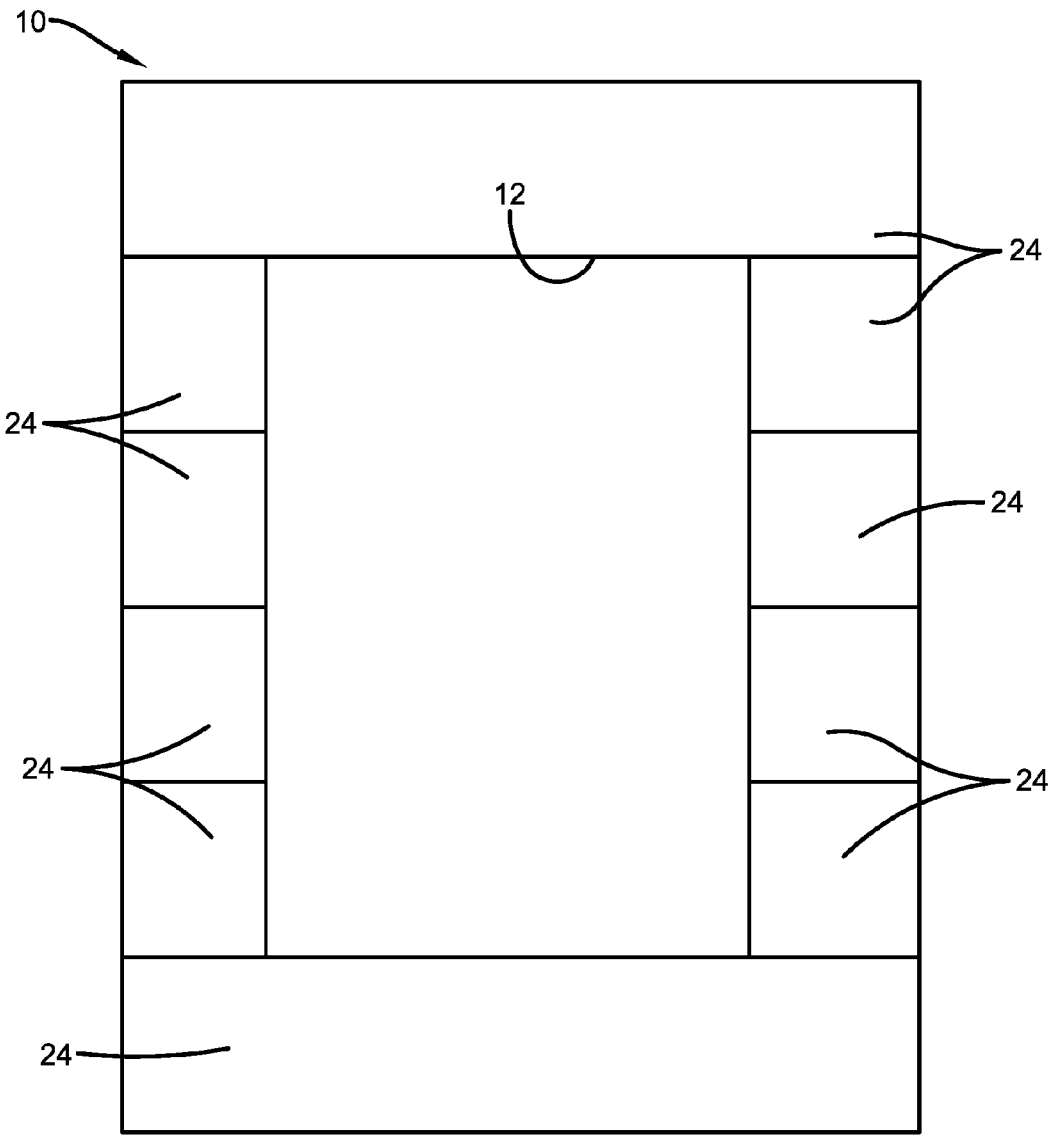
FIG. 10 PRIOR ART
FIG. 10 shows the opening in the structure after a fenestration product has been removed.
Figure 11:
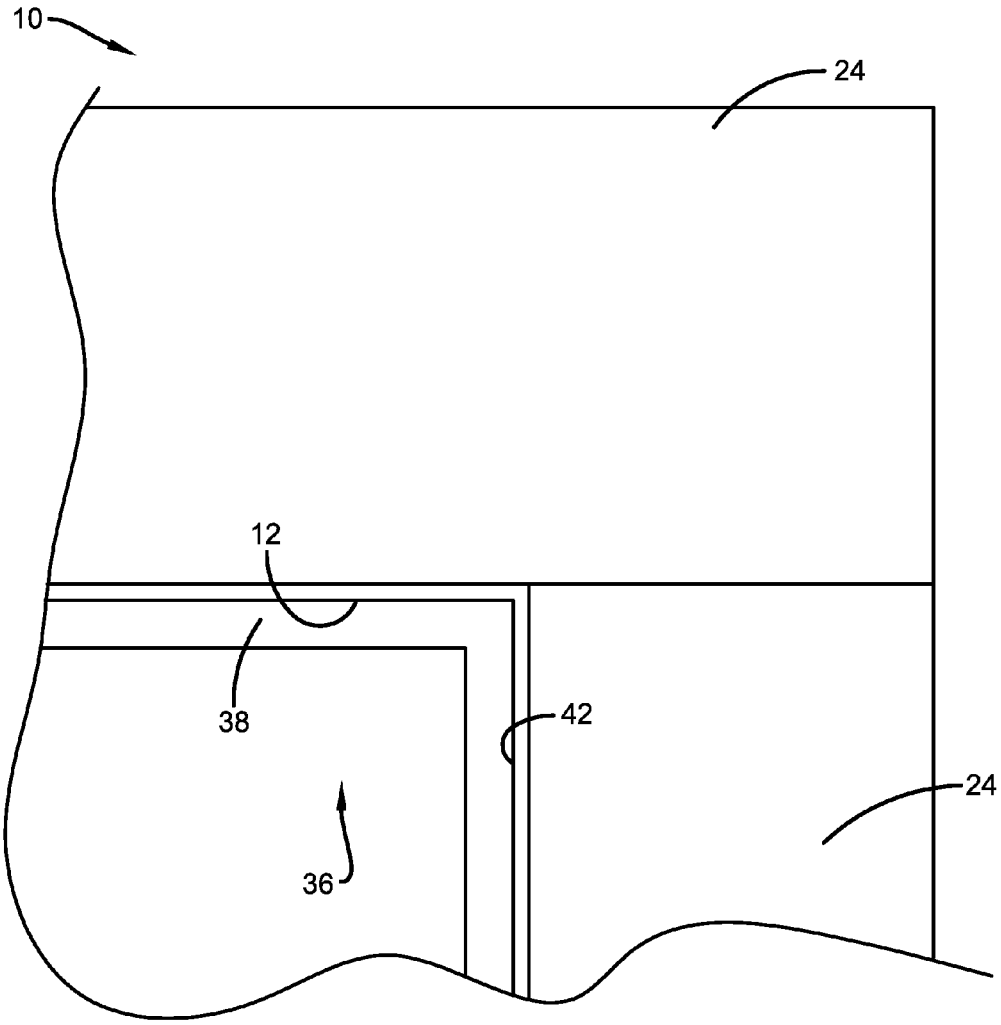
FIG. 11 PRIOR ART
FIG. 11 is a close up view showing the opening or crack between the opening in a structure and the outer periphery of a replacement fenestration product.

Once the original (or previous) fenestration product has been removed, as shown in FIG. 13, and the pieces of the universal adaptor 72 have been prepared (each piece cut to length, the cutouts 90, 92 made to the ends of each piece, and the support wall 80 trimmed on each piece), the universal adaptor 72 can then be used to install a replacement fenestration product such as but not limited to replacement window 36, shown in FIG. 9, into an opening, such as opening 12 shown in FIG. 13. The pieces of the adaptor 72 may be installed one at a time though this is not a requirement. It may be easier to begin with the bottom piece, but this is not a requirement and it may be easier to begin with another piece, depending on the particular application.

Figure 19:
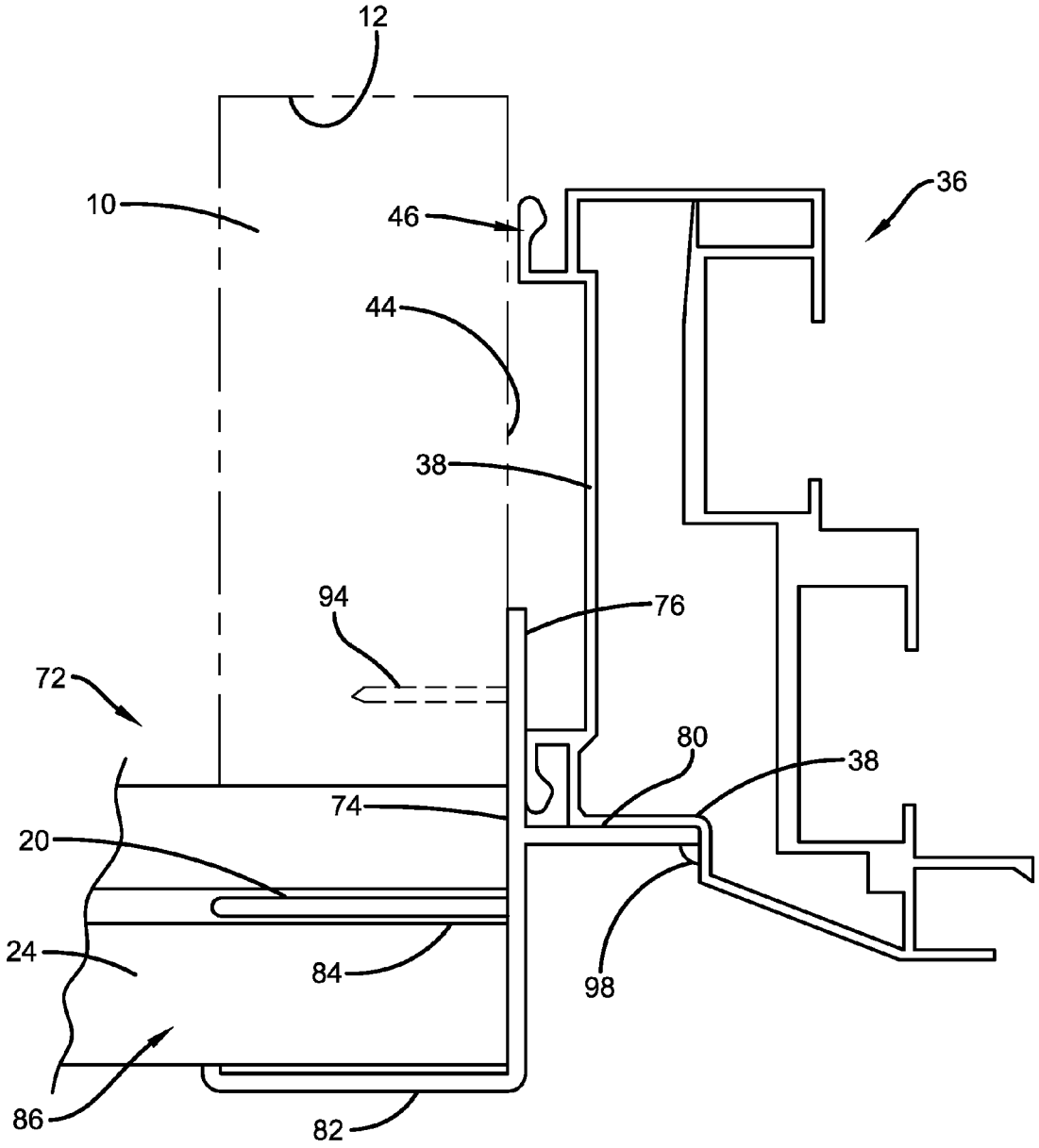
FIG. 19 is a cross-sectional view through a side of a window shown installed to a structure using a universal adaptor according to some embodiments of this invention.

With reference now to FIG. 19, a side piece of the universal adaptor 72 is shown, installed. The method of installing it begins with inserting the proximal end 76 of the main wall 74 into the opening 12 with the orientation shown in FIG. 19. Note that the inner surface of the second receiver wall 84 abuts/contacts the mounting flange 20 remaining from the original (or previous) fenestration product that was removed. One or more connectors 94, which may be nails, screws or any other suitable connector, are then driven/inserted through the proximal end 76 of the main wall 74 and into the structure 10 to secure the first piece to the structure. The other pieces are inserted similarly, with the ends of neighboring pieces engaging as explained above, and connectors 94 are used to secure the distal ends of their main walls to the structure 10 in a similar manner. Note also that exterior panel receiver 86 receives the edges/sides of neighboring siding panels 24. Depending on the particular application, the siding panels 24 can be inserted into the neighboring exterior panel receiver 86 either as each piece of the adaptor 72 is installed or after all the pieces have been installed.

With continuing reference to FIG. 19, once all the pieces of the adaptor 74 have been installed, the fenestration product 36 can then be inserted into the opening 12, from the inside of the structure 10, with the outside surface 48 (see FIG. 9) abutting/contacting the inner surface of support wall 80 and contact surface 46 abutting/contacting periphery 44 (which defines opening 12) of structure 10. The fenestration product 36 can then be secured to the structure 10 in a known manner. A caulking compound 98 may then be inserted all along the surfaces where the outer end of the support wall 80 contacts the frame 38 of the fenestration product 36, as shown. Note that because the caulking compound 98 is used to seal a connection between the adaptor 72 and the fenestration product 36, the quality of the seal is much greater than the quality of the seal made when caulking compound is used between the structure 10 and the fenestration product 36, as is commonly done. Thus, this invention provides an easy method of installing fenestration products that also provides a high quality seal between components.

Figure 20:
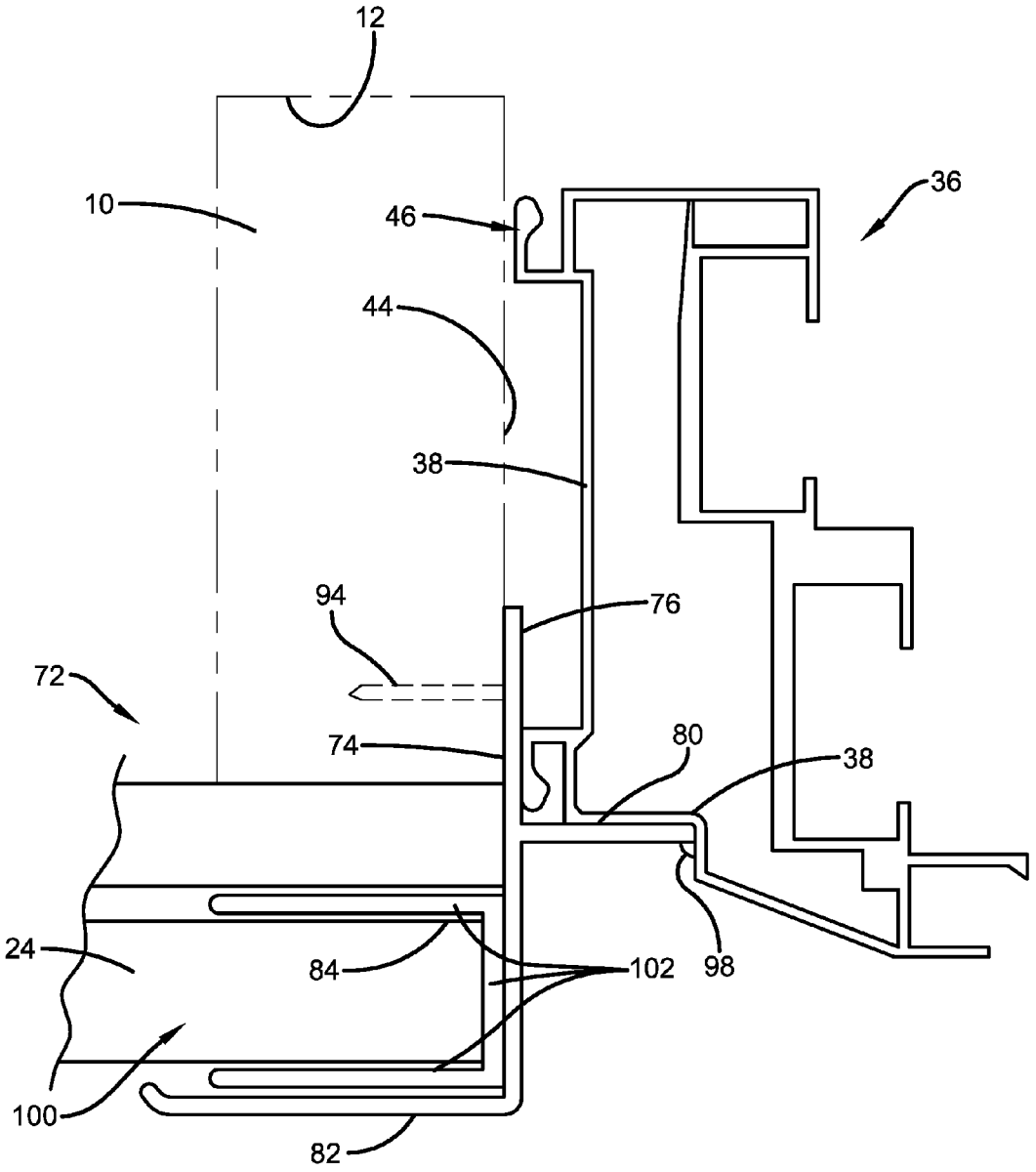
FIG. 20 is a cross-sectional view through a side of a window shown installed to a structure using a universal adaptor according to other embodiments of this invention.

With reference now to FIG. 20, a side piece of the universal adaptor 72 is shown installed in another embodiment. For this embodiment, a pre-installed exterior panel receiver 100 defined by structure 102 is re-used. The pre-installed exterior panel receiver 100 may have been part of the original (and/or previous) fenestration product. The preparation of adaptor 72 for installation in this case is the same as described above, except an addition step is required: the second receiver wall 84 (see FIG. 12) is cut/trimmed off of the main wall 74. This cut may also be made on site using the tool 112 shown in FIG. 18 in the same manner, using score lines, as described above. This creates room proximally (above, as shown) the first receiver wall 82 to receive the pre-installed exterior panel receiver 100. The installation of the adaptor 72 pieces is also as explained above except: (1) as the adaptor pieces 72 are inserted, the inner surface of the first receiver wall 82 abuts/contacts the outer surface of the pre-installed structure 102; and, (2) the siding panels 24 can be inserted into the neighboring exterior panel receiver 100 (not exterior panel receiver 86).

Figure 1:
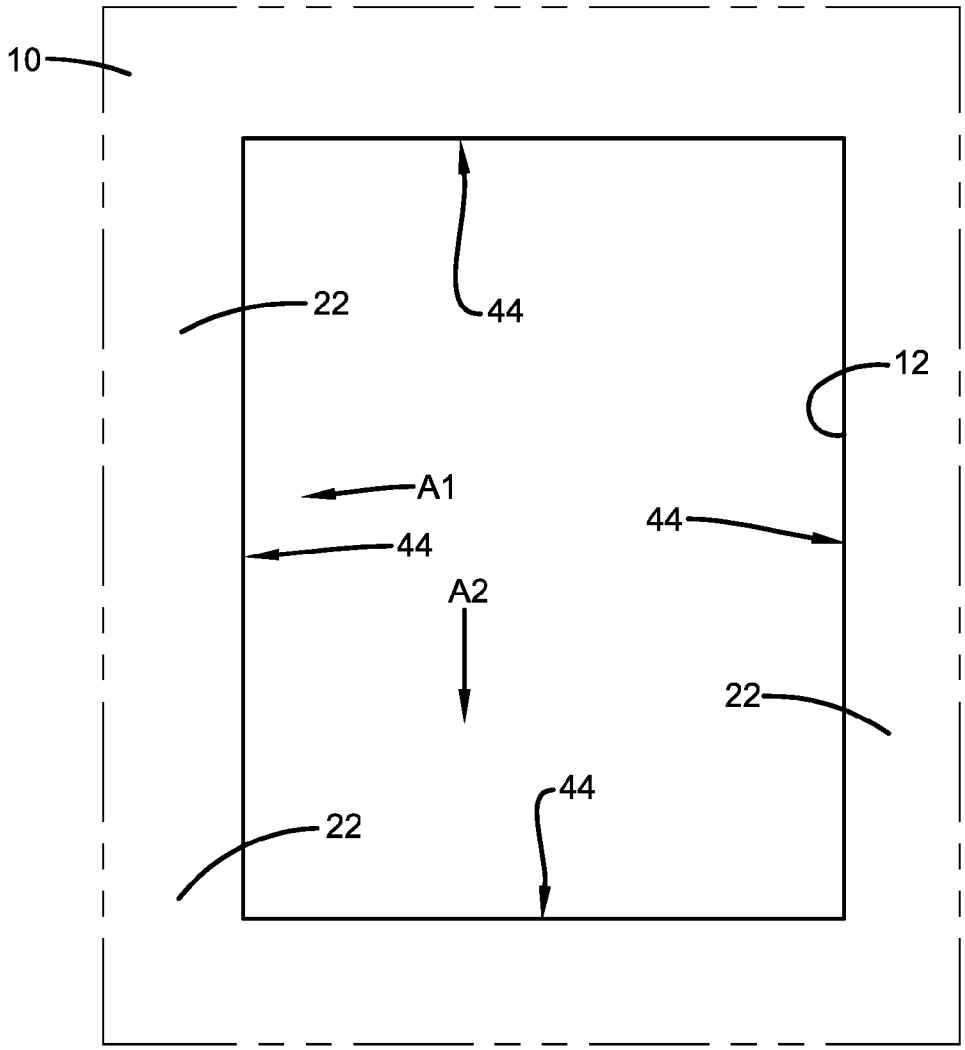
FIG. 1 PRIOR ART
FIG. 1 is an outside view of a structure having an opening into which a fenestration product such as but not limited to a window may be installed.
Figure 2:
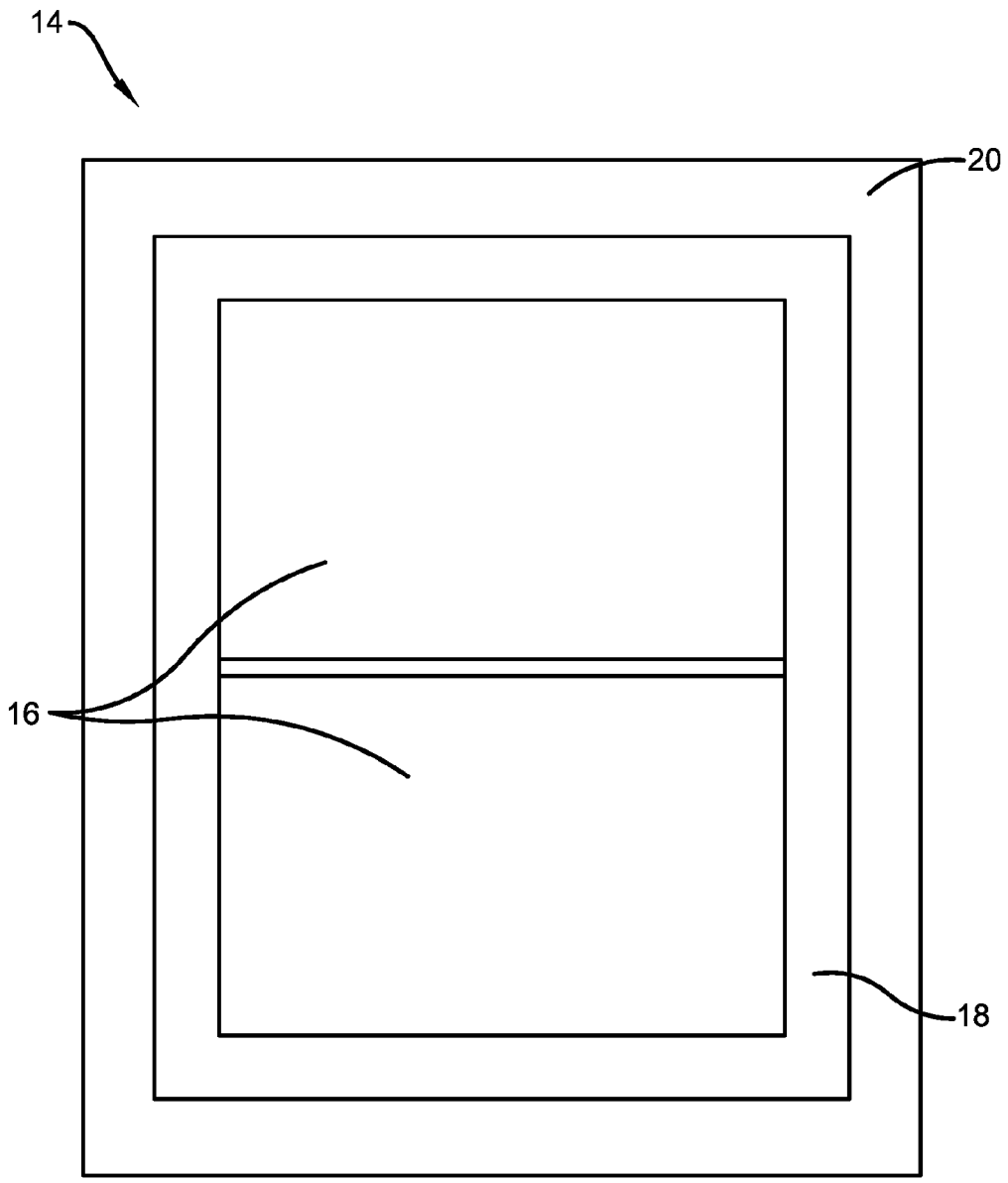
FIG. 2 PRIOR ART
FIG. 2 is a front view of a known new construction fenestration product, a window.
Figure 3:
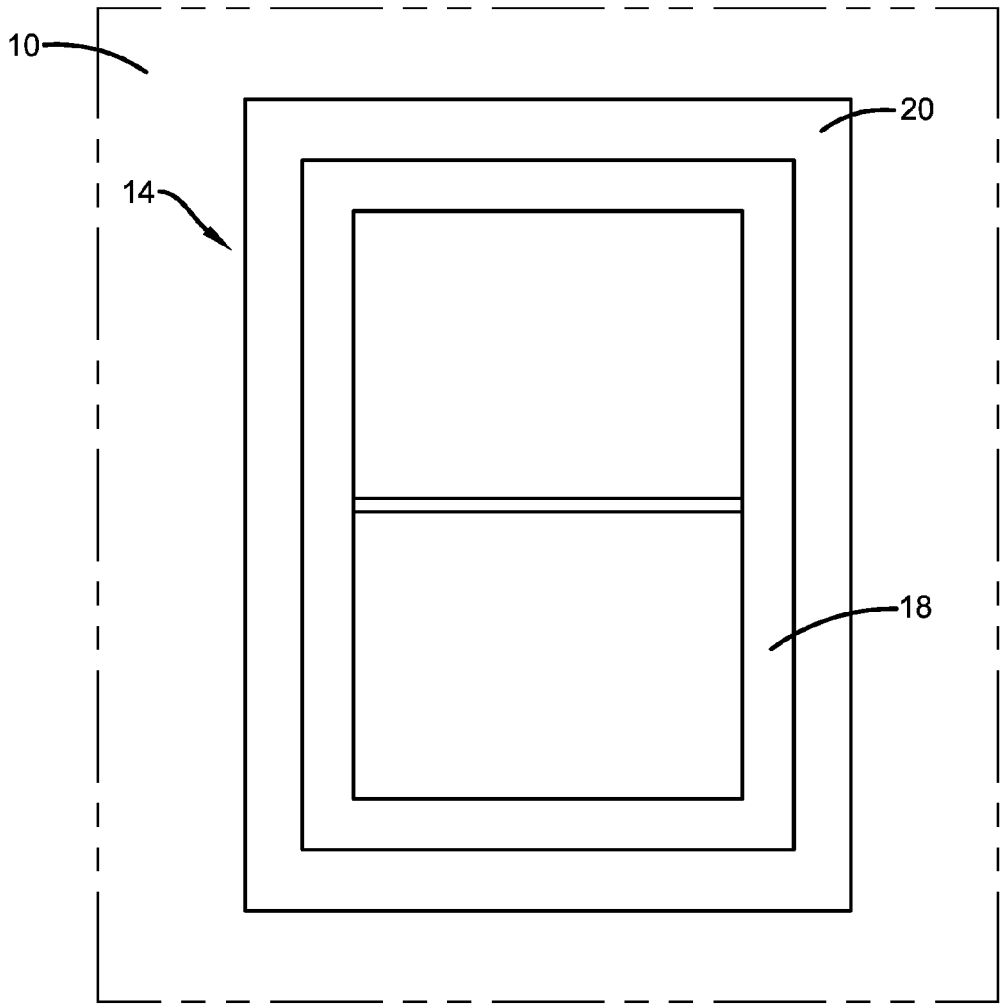
FIG. 3 PRIOR ART
FIG. 3 shows the window of FIG. 2 installed into the opening of the structure shown in FIG. 1.
Figure 4:
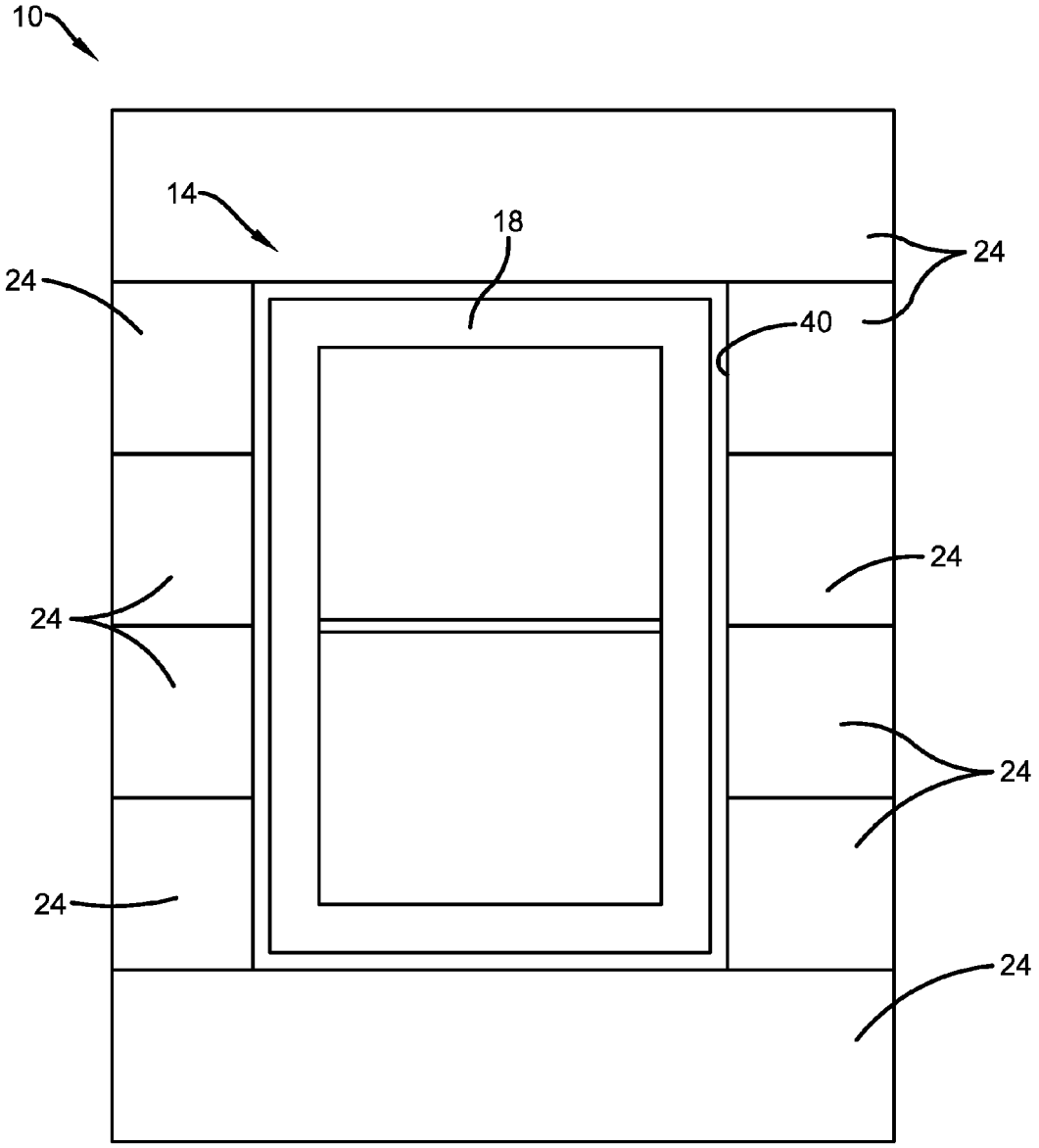
FIG. 4 PRIOR ART
FIG. 4 shows siding panels added to the structure and window shown in FIG. 3.
Figure 21:
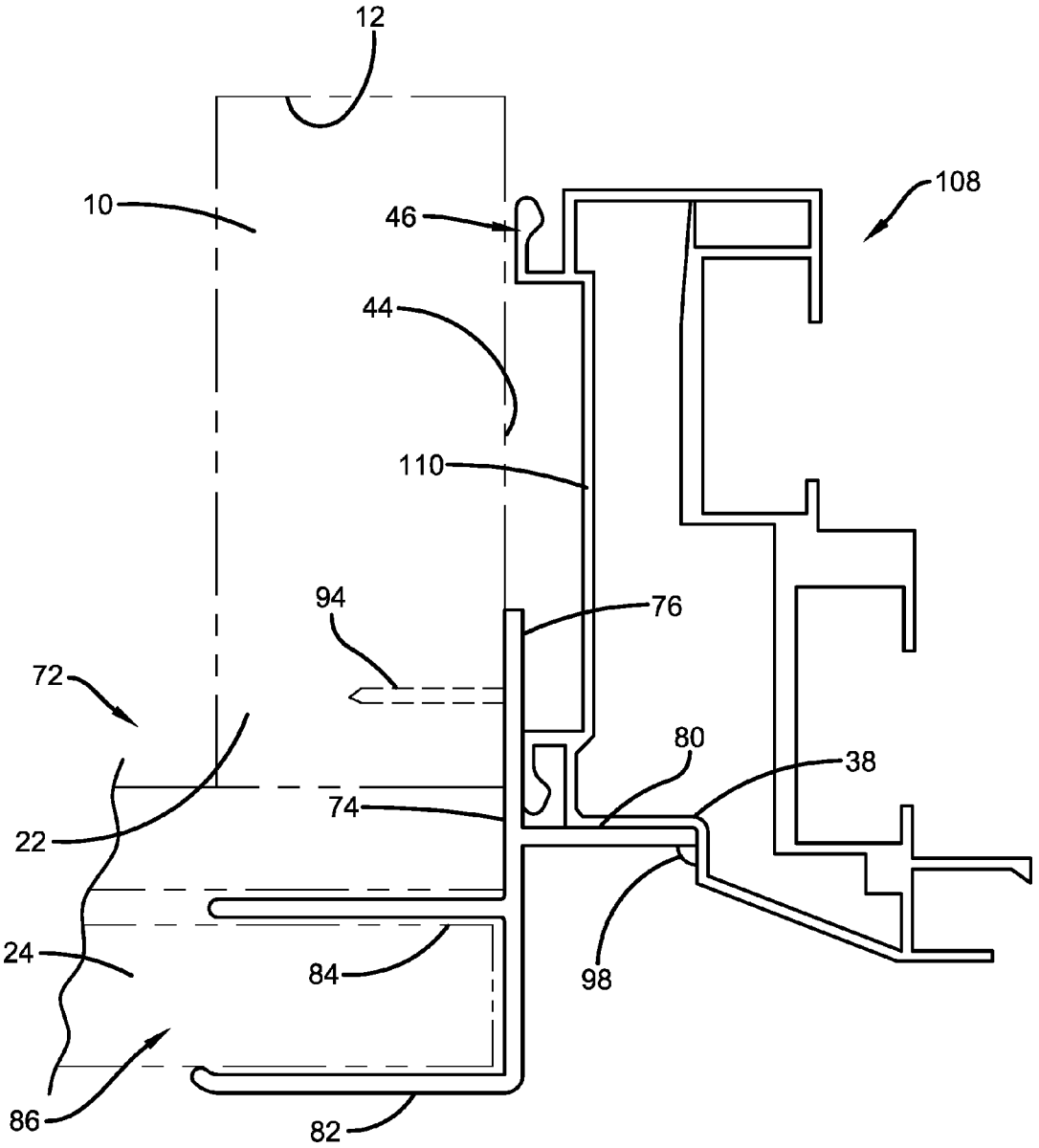
FIG. 21 is a cross-sectional view through a side of a window shown installed to a structure using a universal adaptor according to yet other embodiments of this invention.

With reference now to FIG. 21, a side piece of the universal adaptor 72 is shown installed in another embodiment. Previously it was discussed how the adaptor 72 of this invention is especially adapted for use when installing a replacement fenestration product. It can also be used, however, when installing a new fenestration product, such as window 108, having a frame 110, as shown in FIG. 21, into a newly constructed structure 10. For this embodiment, the new fenestration product is similar to the previously described replacement fenestration product 36, shown in FIG. 9. Because the window 108 in this embodiment is installed into a new construction structure 10, there is no reason to create cutout areas 52, 58 (shown in FIGS. 5 and 6). The installation of the fenestration product 108 is similar to the installation of fenestration product 36 described above with reference to FIG. 19 except that as the adaptor pieces 72 are installed, the inner surfaces of the second receiver walls 84 abut/contact the surfaces 22 of the structure 10 (see also FIG. 1).

Figure 24:
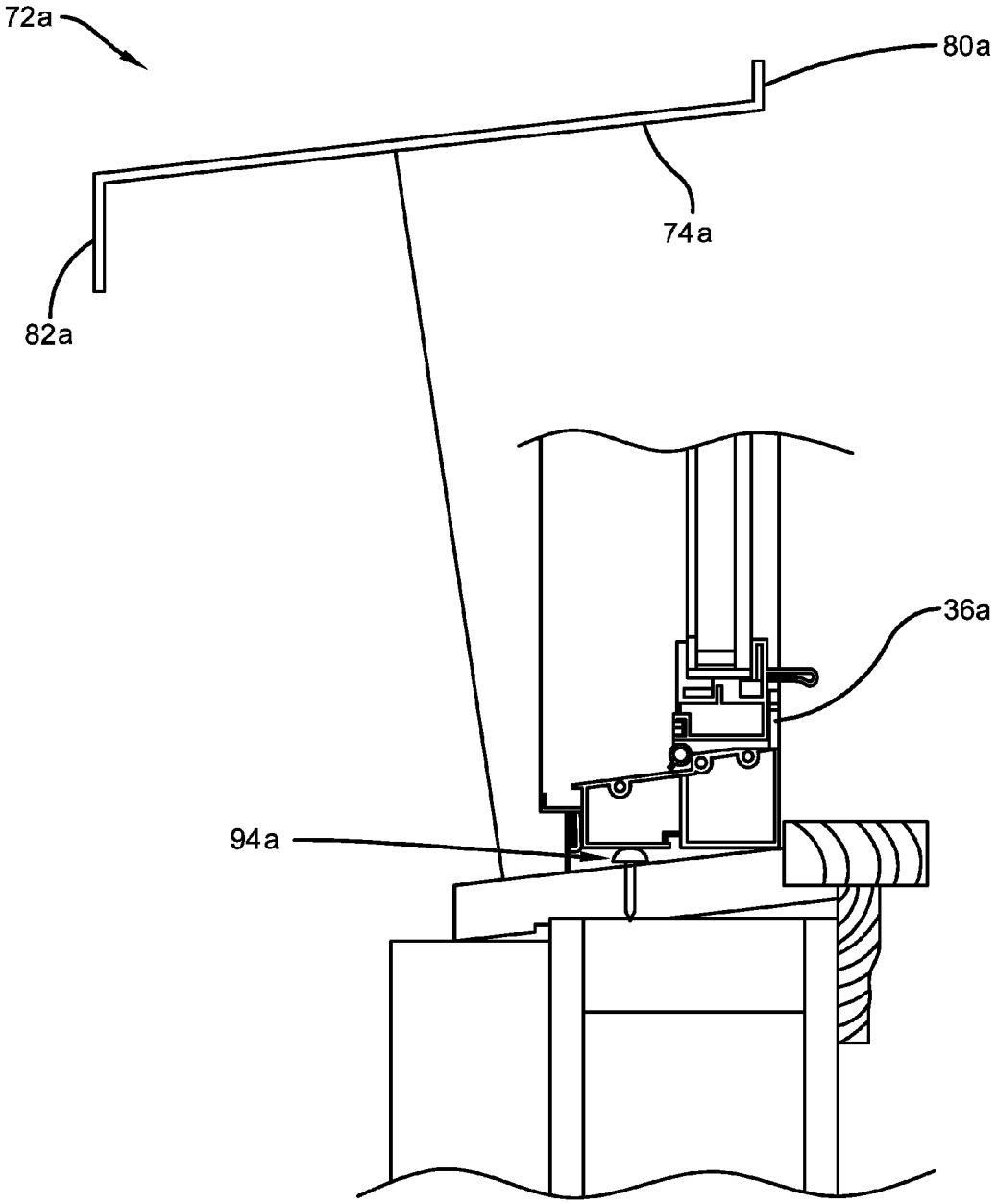
FIG. 24 illustrates another adaptor embodiment at the top and an example of its use at the bottom.
Figure 25:
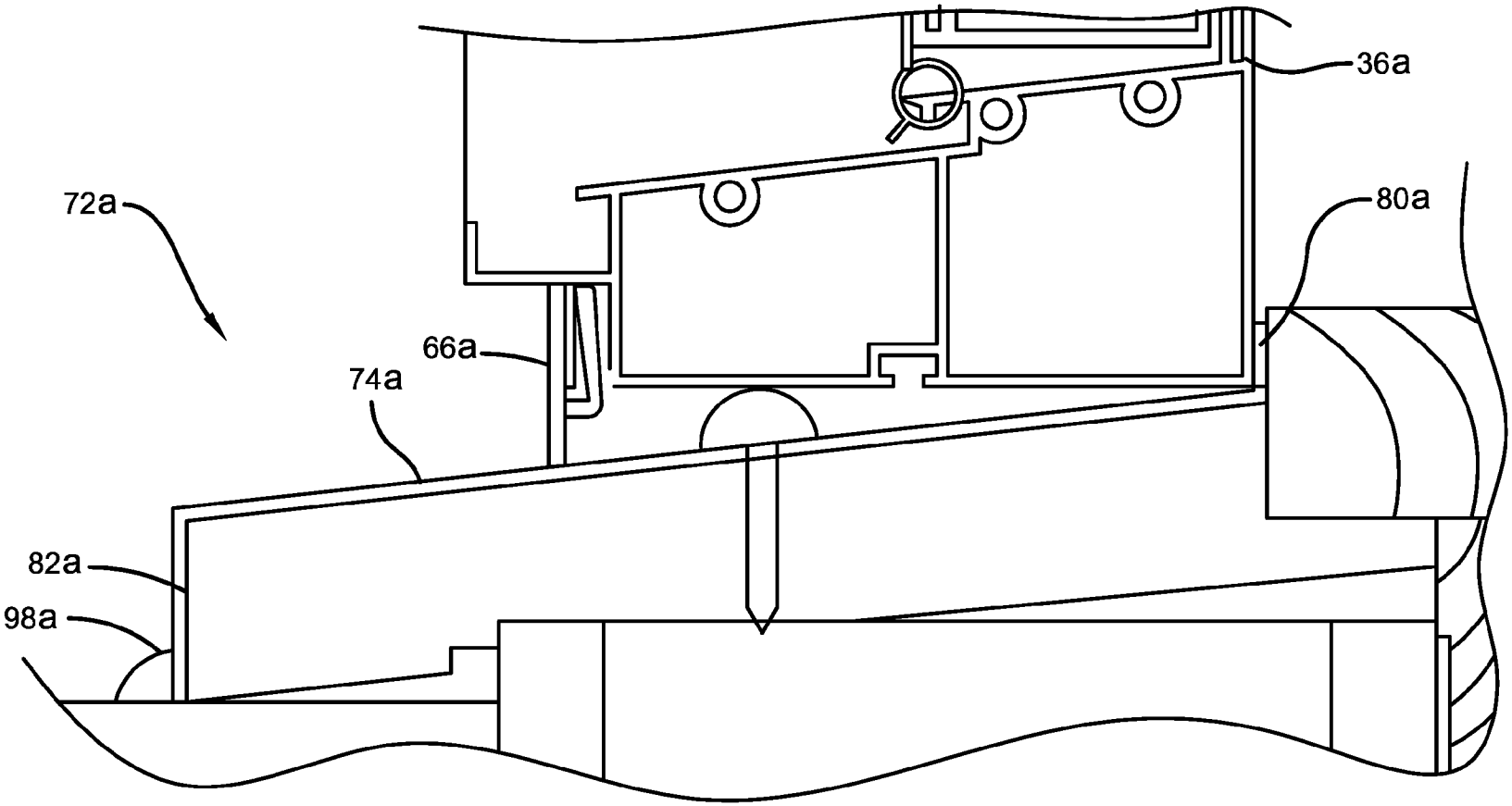
FIG. 25 is a close up view of the bottom portion of FIG. 24.

While the component 70 and thus the universal adaptor 72 described above has a particular cross-sectional shape, it should be understood that universal adaptors made from components according to this invention can have any cross-sectional shape chosen with the sound judgment of a person of skill in the art. FIGS. 24 and 25 show another universal adaptor 72*a* used to support a fenestration product 36*a* to a structure. The adaptor 72*a* may have a main wall 74*a*, a support wall 80*a* and a receiver wall 82*a*. Note that for this embodiment the main wall 74*a* is angled with respect to the support wall 80*a* and receiver wall 82*a*. Note also that the support wall 80*a* extends from one end and one side of the main wall 74*a* while the receiver wall 82*a* extends from the opposite end and opposite side of the main wall 74*a*. The adaptor 72*a* may be secured to the structure, in this embodiment a window sill, with connector 94*a* and a sill extender support (sometimes referred to as a bridge support) 66*a* as is well known in the art. A caulking compound or other sealant 98*a* may be used to seal a connection between the adaptor 72*a* and the structure.

Figure 26:
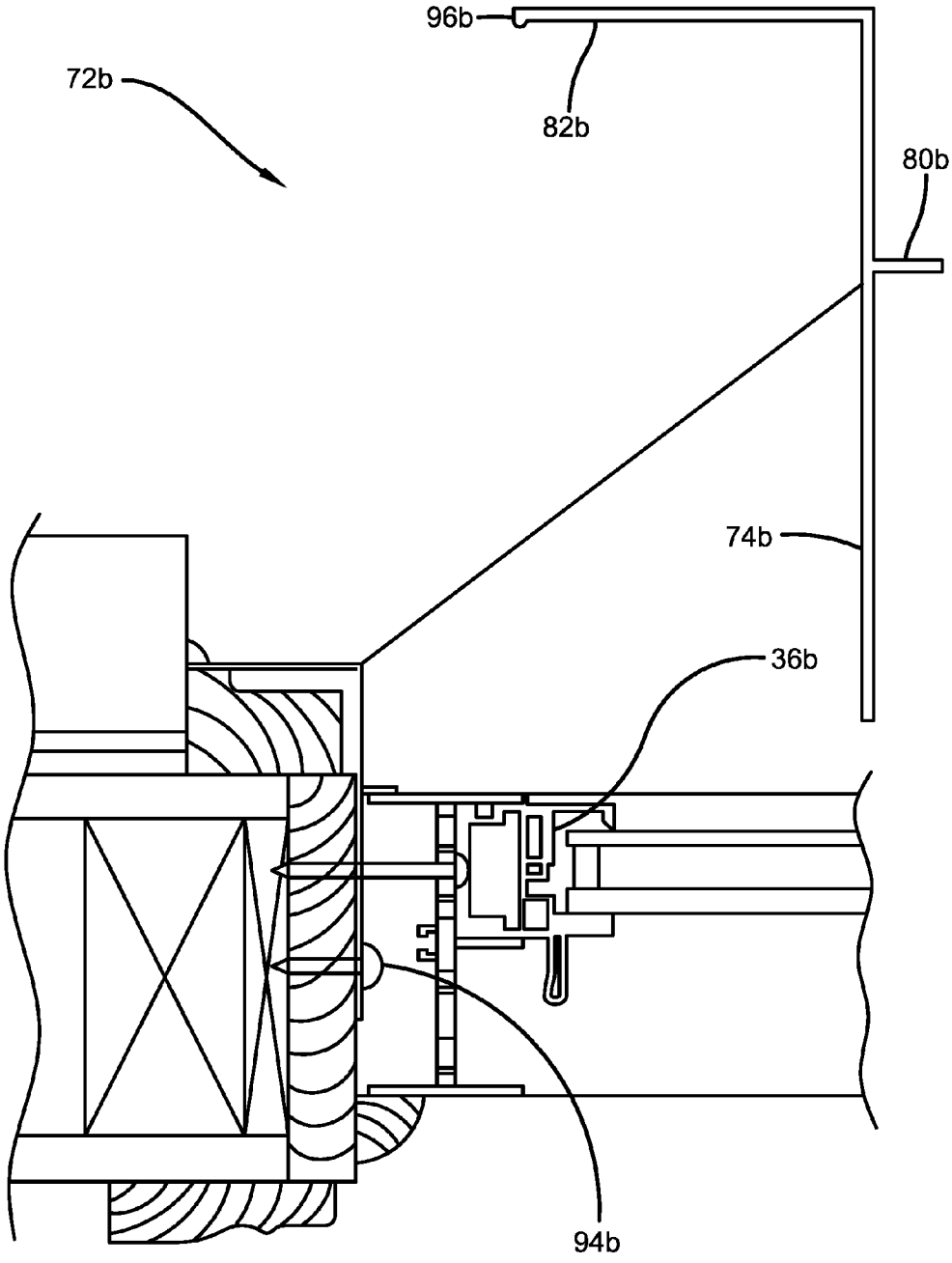
FIG. 26 illustrates another adaptor embodiment at the top and an example of its use at the bottom.
Figure 27:
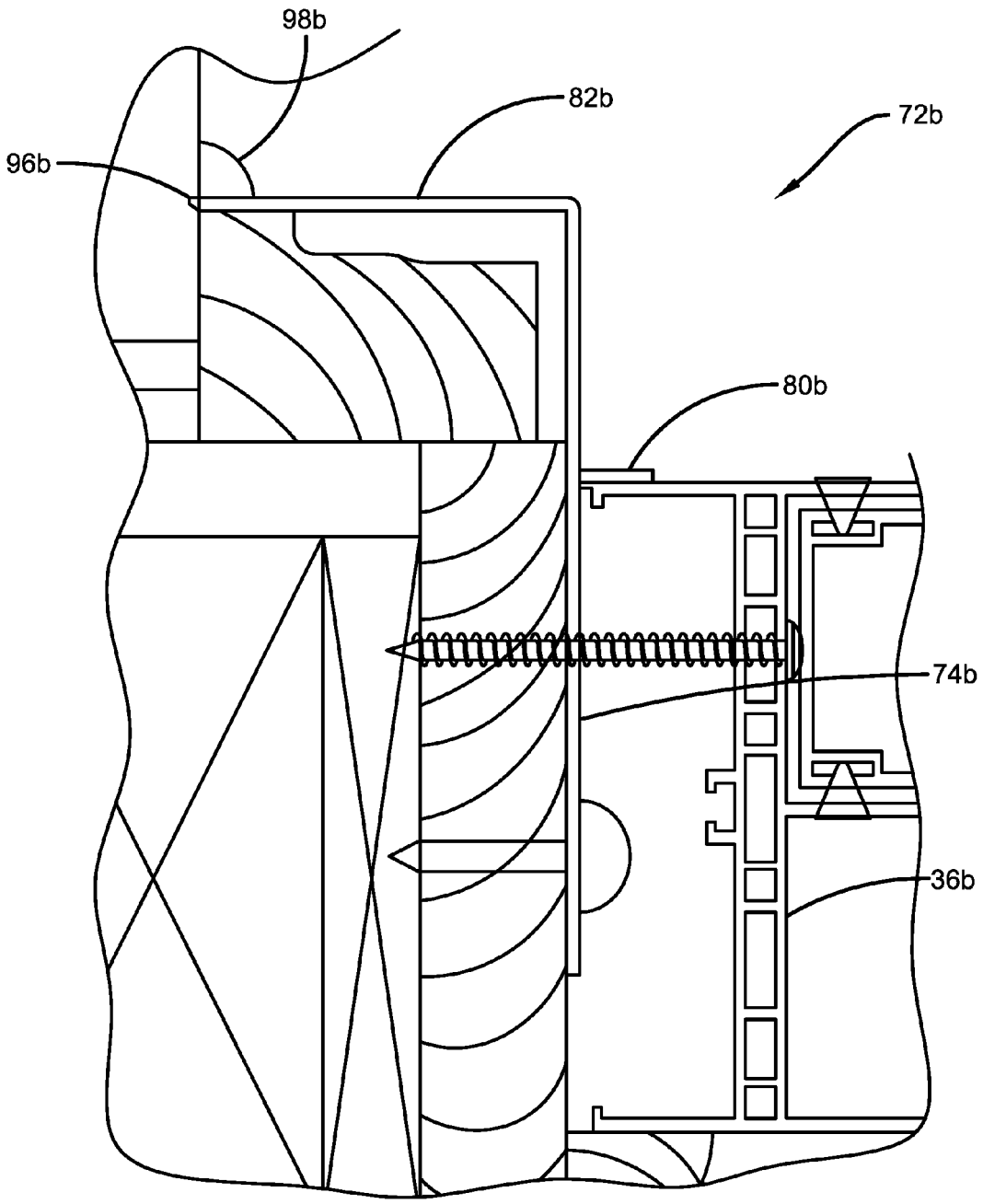
FIG. 27 is a close up view of the bottom portion of FIG. 26.

FIGS. 26 and 27 show another universal adaptor 72*b* used to support a fenestration product 36*b* to a structure. The adaptor 72*b* may have a main wall 74*b*, a support wall 80*b* and a receiver wall 82*b*. Note that for this embodiment the support wall 80*b* extends from one side of the main wall 74*b* at a mid-section of the main wall 74*b* while the receiver wall 82*b* extends from the opposite side of the main wall 74*b* at an end of the main wall 74*b*. Note also that the end of the support wall 82*b* has curved outer surface 96*b*. The adaptor 72*b* may be secured to the structure with connector 94*b* and a caulking compound or other sealant 98*b* may be used to seal a connection between the adaptor 72*b* and the structure.

Figure 28:
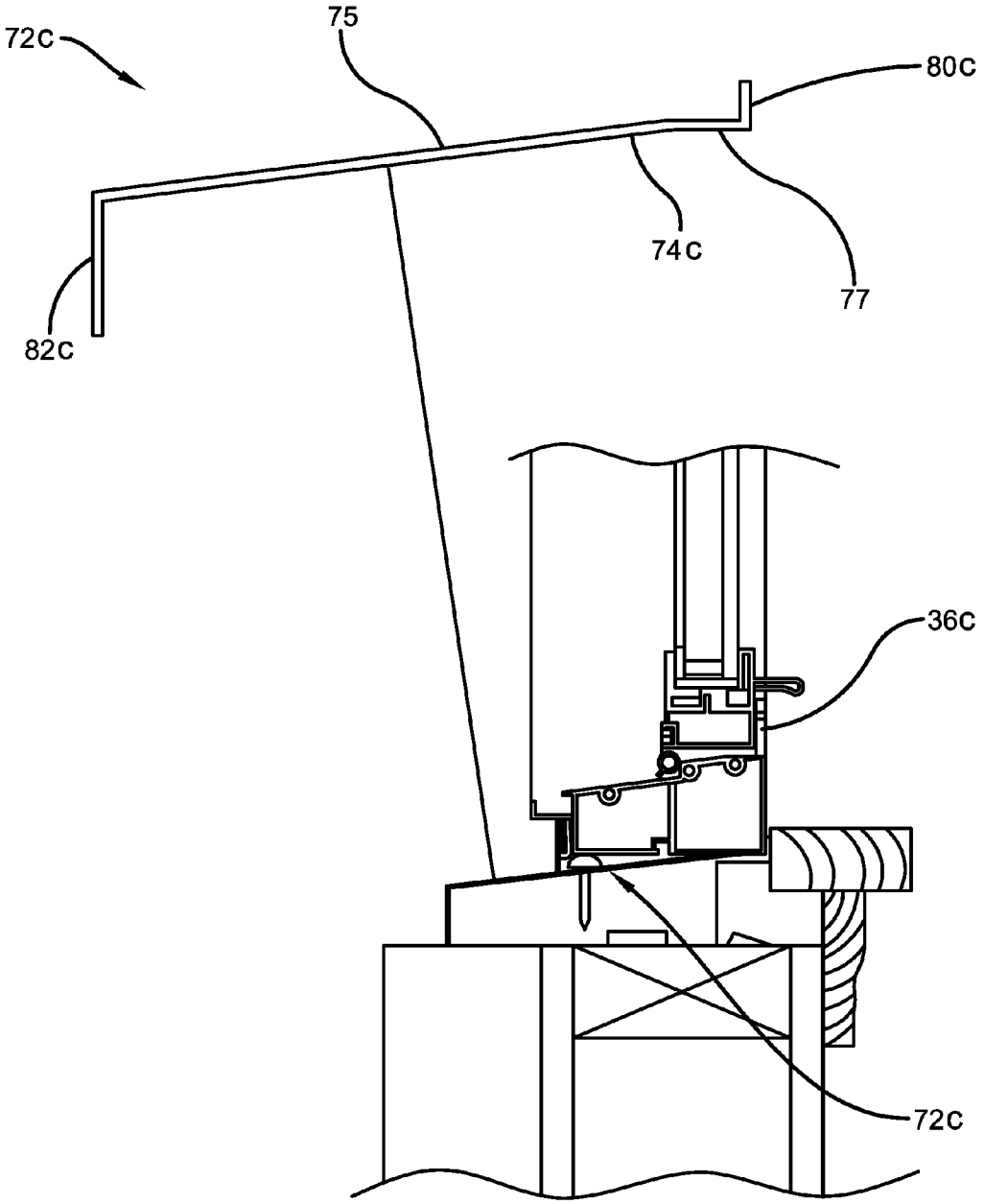
FIG. 28 illustrates another adaptor embodiment at the top and an example of its use at the bottom.
Figure 29:
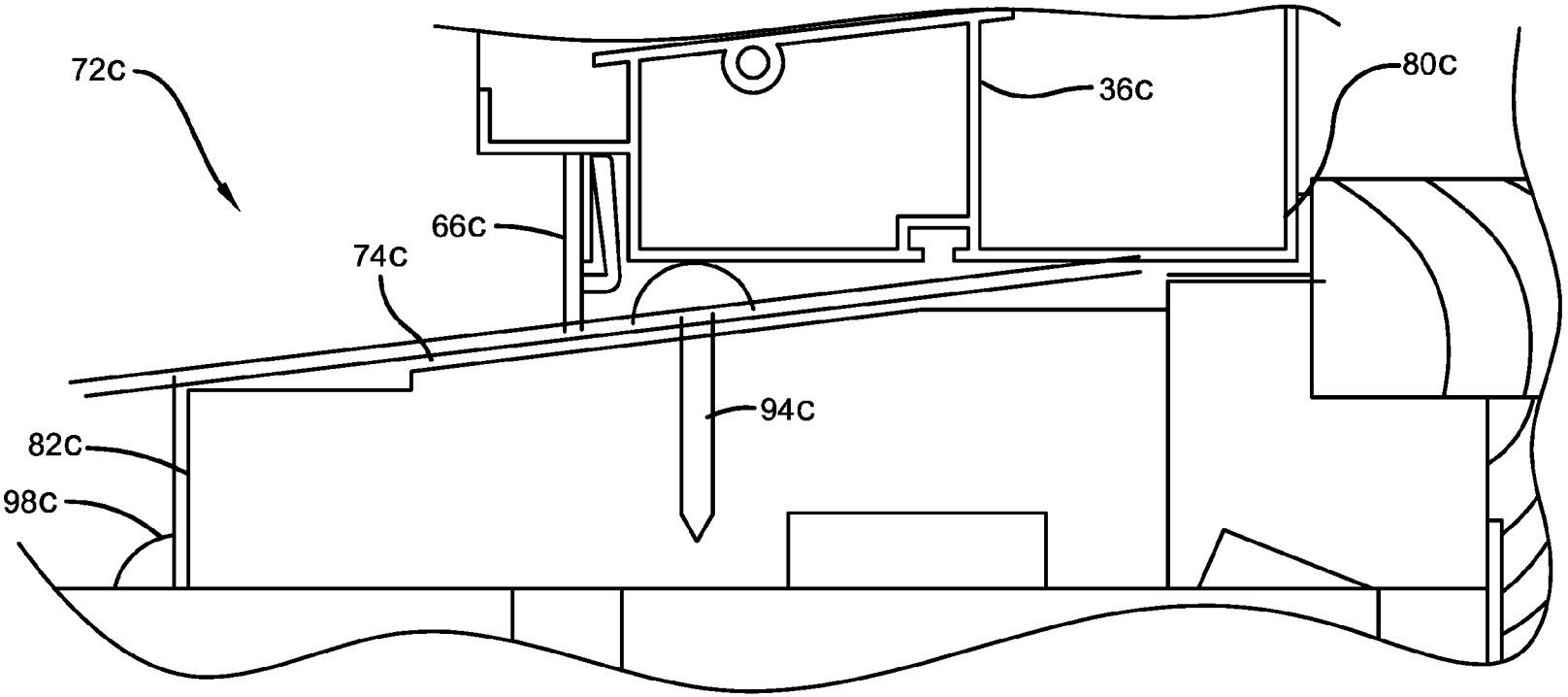
FIG. 29 is a close up view of the bottom portion of FIG. 28.

FIGS. 28 and 29 show another universal adaptor 72*c* used to support a fenestration product 36*c* to a structure. The adaptor 72*c* may have a main wall 74*c*, a support wall 80*c* and a receiver wall 82*c*. Note that for this embodiment the support wall 80*c* extends from one side of the main wall 74*c* at one end of the main wall 74*c* while the receiver wall 82*c* extends from the opposite side of the main wall 74*b* at an opposite end of the main wall 74*c*. Note also that the main wall 74*c* has two parts, 75 and 77 that are angled with respect to each other and thus on different planes. This design is suitable for this application. The adaptor 72*c* may be secured to the structure, in this embodiment a window sill, with connector 94*c* and a sill extender support (or bridge support) 66*c* as is well known in the art. A caulking compound or other sealant 98*c* may be used to seal a connection between the adaptor 72*c* and the structure.

Figure 30:
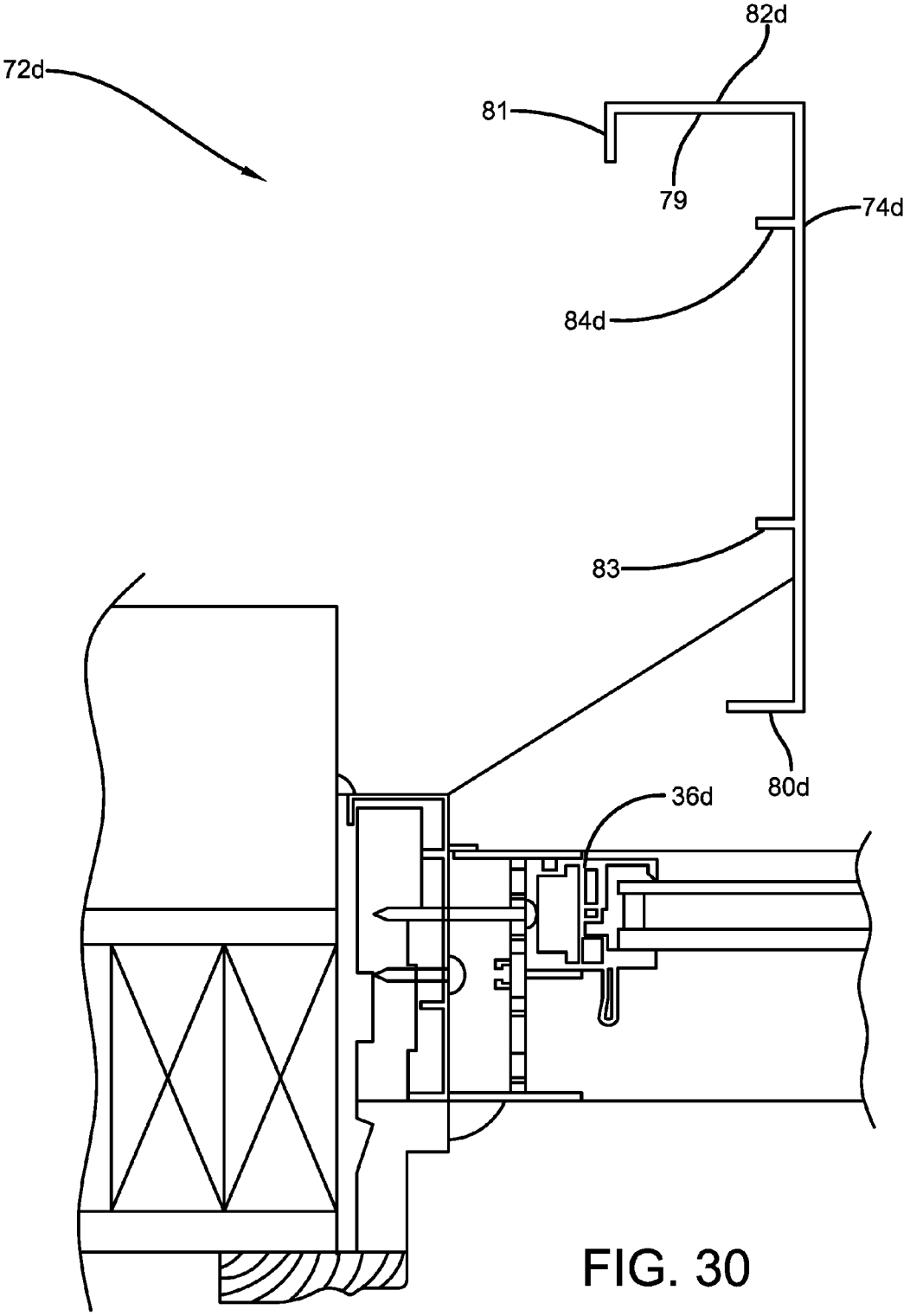
FIG. 30 illustrates another adaptor embodiment at the top and an example of its use at the bottom.
Figure 31:
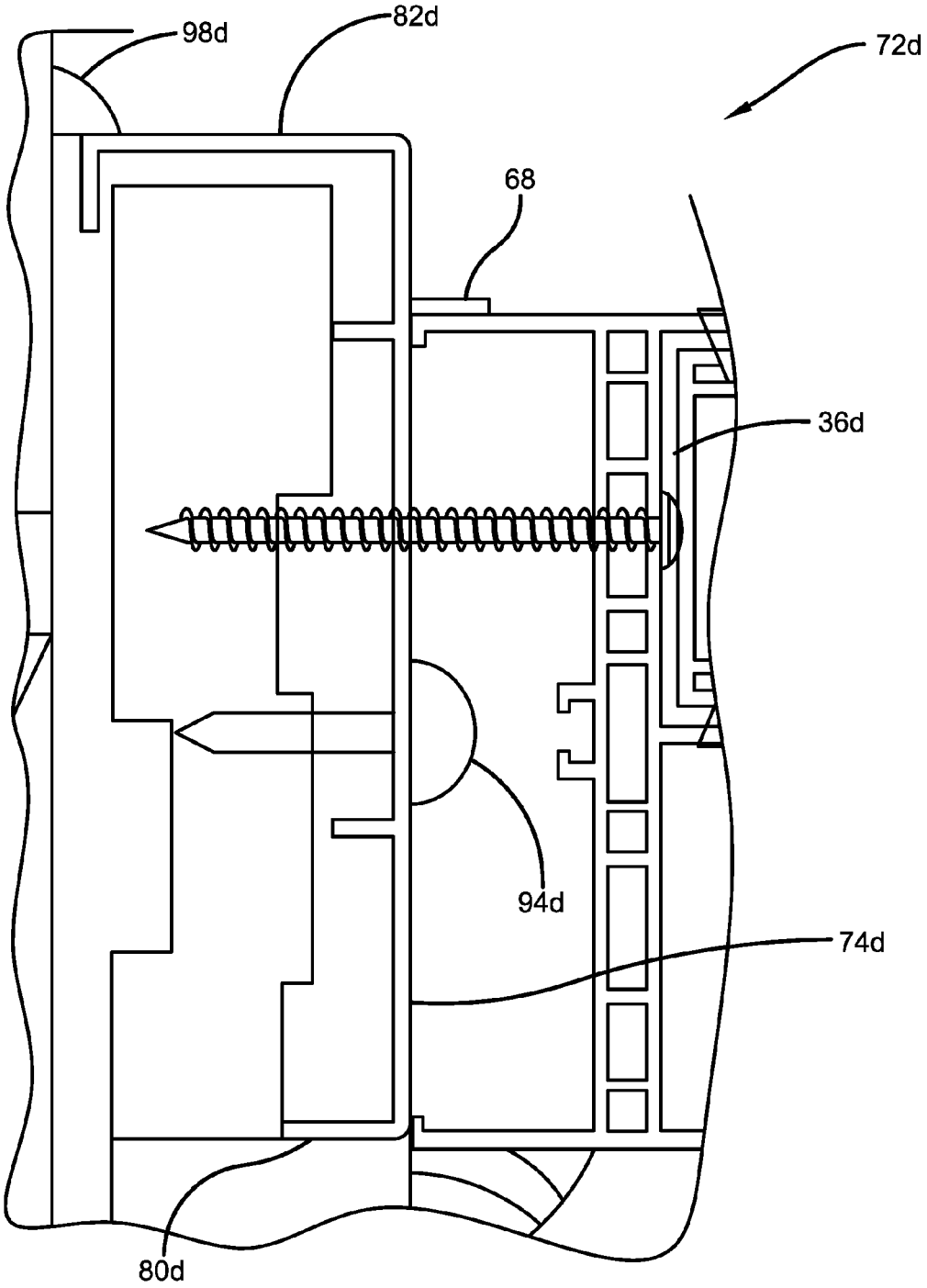
FIG. 31 is a close up view of the bottom portion of FIG. 30.

FIGS. 30 and 31 show another universal adaptor 72*d* used to support a fenestration product 36*d* to a structure. The adaptor 72*d* may have a main wall 74*d*, a support wall 80*d* and a receiver wall 82*d*. Note that for this embodiment the support wall 80*d* extends from one side of the main wall 74*d* at one end of the main wall 74*d* while the receiver wall 82*d* extends from the same side of the main wall 74*d* at an opposite end of the main wall 74*d*. Note also that the receiver wall 82*d* has two parts, 79 and 81 that are angled with respect to each other (at a right angle or 90 degrees in the embodiment shown) and thus are on different planes. For this embodiment, the main wall 74*d* also has second and third receiver walls 84*d* and 83 that extend therefrom. This design is suitable for this application, as shown. The adaptor 72*d* may be secured to the structure with connector 94*d* and a caulking compound or other sealant 98*d* may be used to seal a connection between the adaptor 72*d* and the structure. A trim component 68 that comes with the fenestration product 365 may optionally be used.

Figure 32:
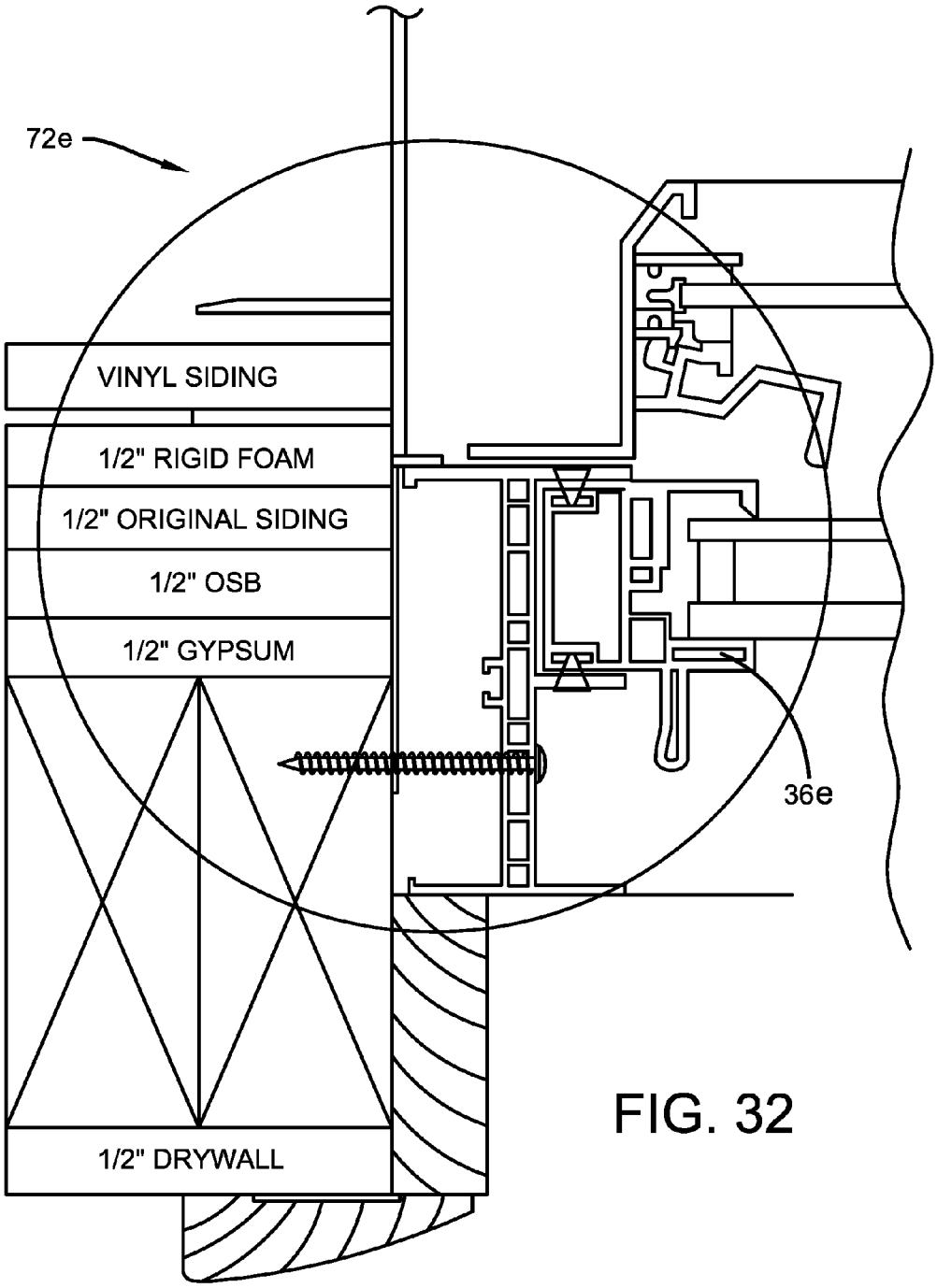
FIG. 32 illustrates another adaptor embodiment.
Figure 33:
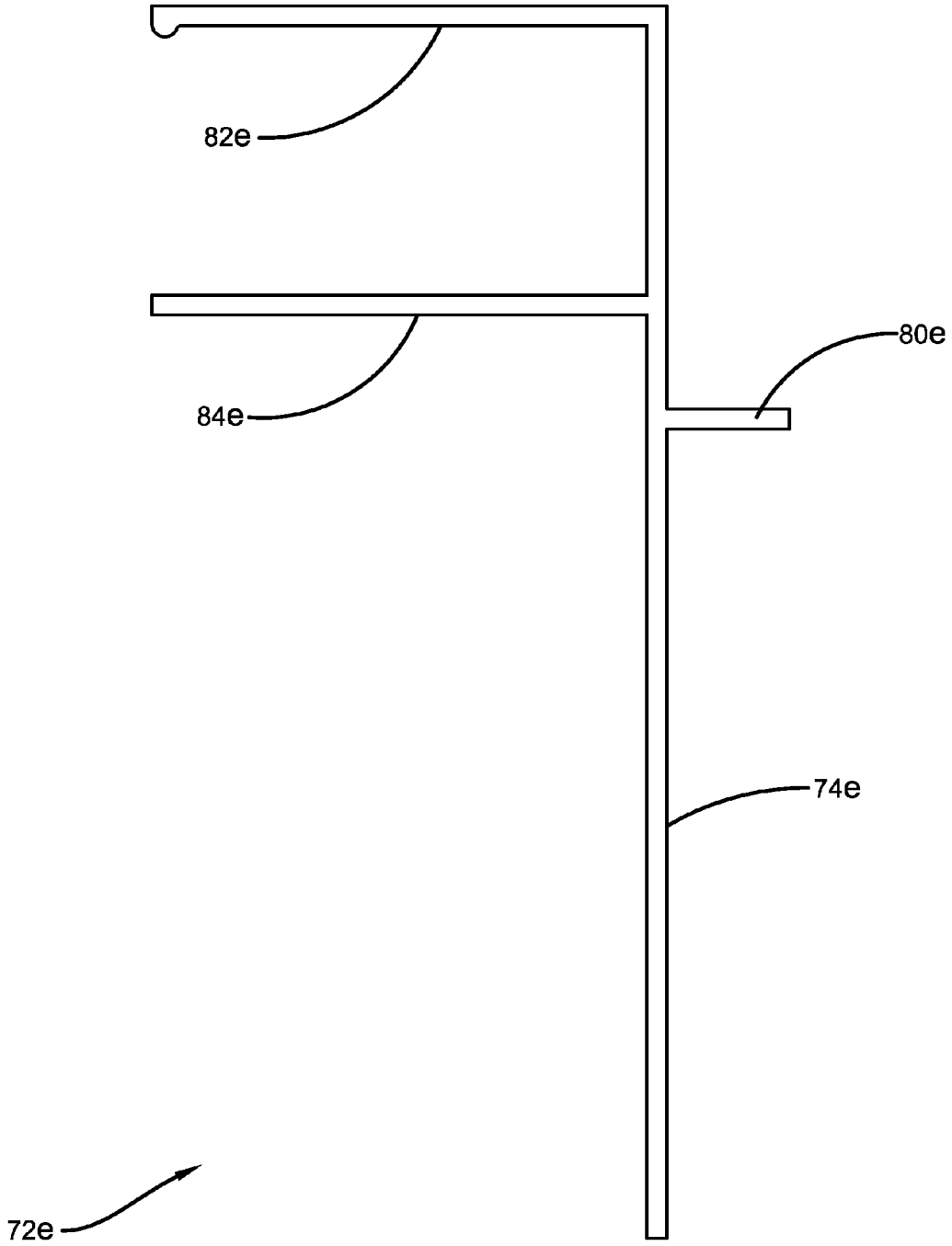
FIG. 33 is a close up view of the adaptor shown in FIG. 32.

FIGS. 32 and 33 show another universal adaptor 72*e* used to support a fenestration product 36*e* to a structure. This structure includes an outer wall portion with layers labeled "vinyl siding," "rigid foam" (with half inch thickness indicated), "original siding" (with half inch thickness indicated), "OSB" (which means Oriented Strand Board and with half inch thickness indicated), and "gypsum" (with half inch thickness indicated). This structure also includes an inner wall portion with a layer of "drywall" (with half inch thickness indicated). This is simply one specific embodiment where the universal adaptor 72*e* can be used but the universal adaptor 72*e* can be used in any application chosen with the sound judgment of a person of skill in the art. The adaptor 72*e* may have a main wall 74*e*, a support wall 80*e* and first and second receiver walls 82*e* and 84*e*. Note that adaptor 72*e* is similar to adaptor 72 described above (see, for example, FIG. 13) but with wall lengths and relative positions varied to meet the specific requirement.

Figure 34:
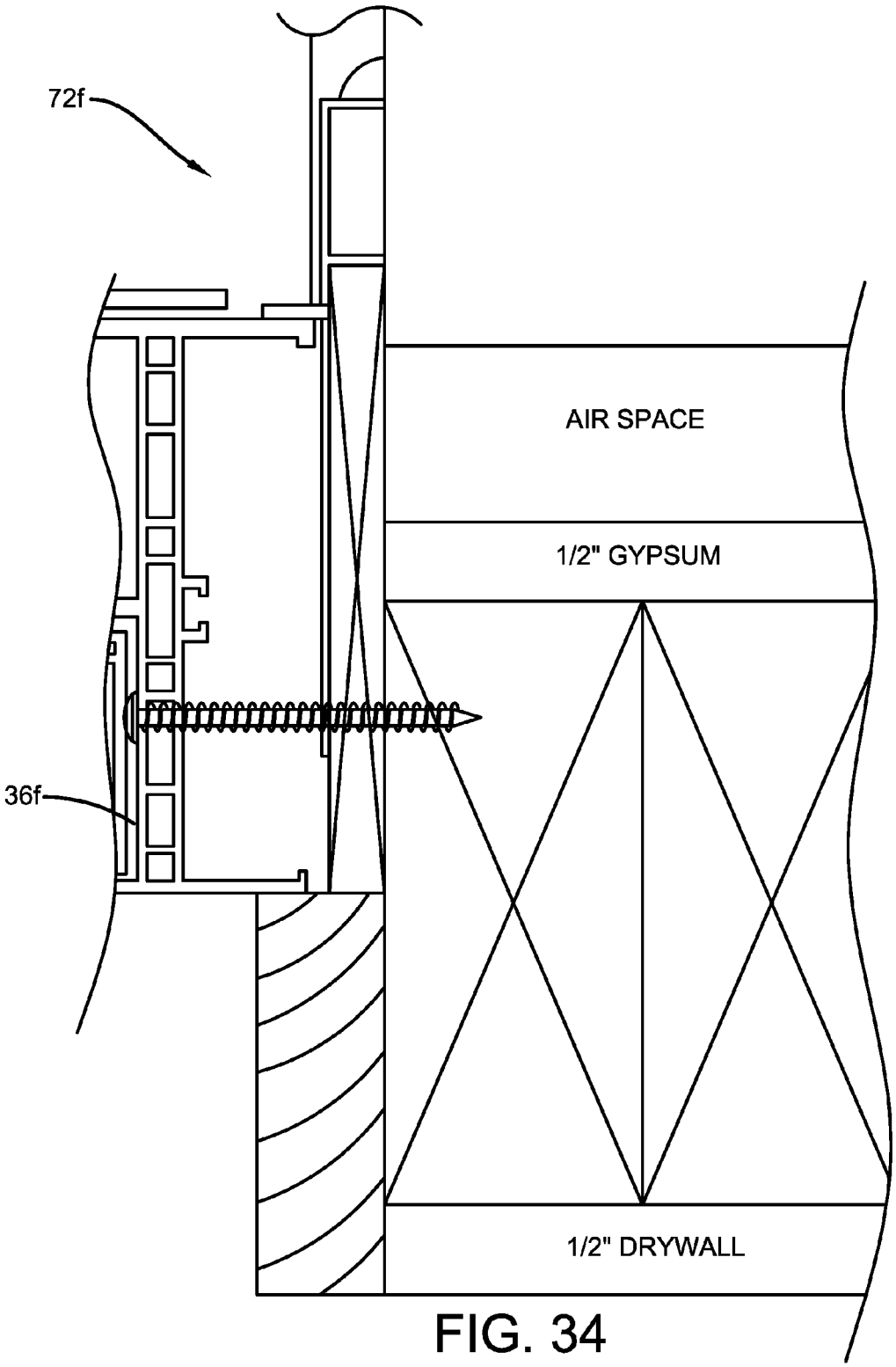
FIG. 34 illustrates another adaptor embodiment.
Figure 35:
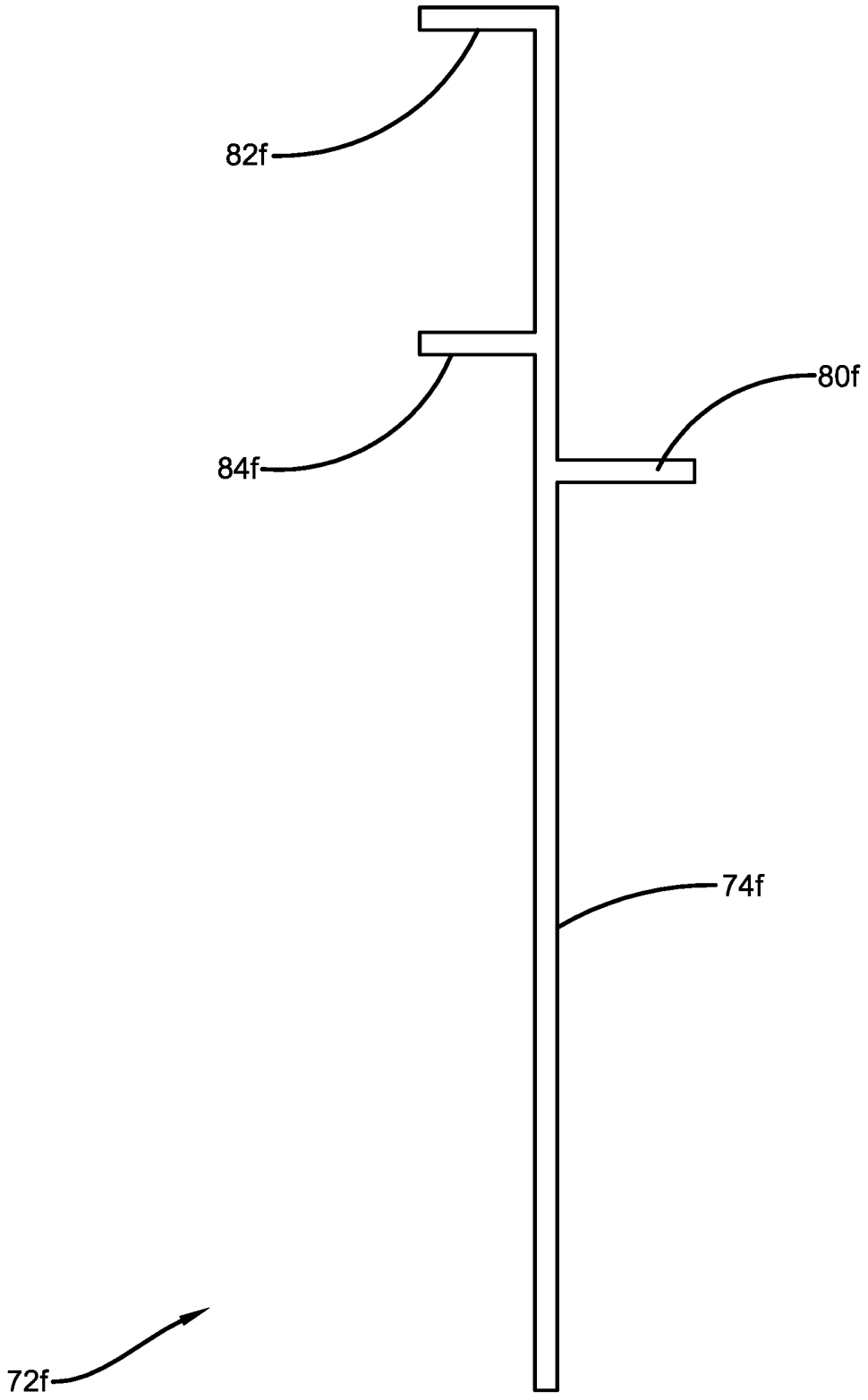
FIG. 35 is a close up view of the adaptor shown in FIG. 34.

FIGS. 34 and 35 show another universal adaptor 72*f* used to support a fenestration product 36*f* to a structure. This structure includes an outer wall portion with layers labeled "brick," "air space", and "gypsum" (with half inch thickness indicated). This structure also includes an inner wall portion with a layer of "drywall" (with half inch thickness indicated). This is simply one specific, non-limiting embodiment where the universal adaptor 72*f* can be used. The adaptor 72*f* may have a main wall 74*f*, a support wall 80*f* and first and second receiver walls 82*f* and 84*f*. Note that adaptor 72*f* is just like adaptor 72*e* described above (see, for example, FIG. 33) but with the lengths of walls 82*f* and 84*f* shorter that walls 82*e* and 84*e*. One way to acquire adaptor 72*f* is to take adaptor 72*e* and cut or trim walls 82*e* and 84*e* to the widths of walls 82*f* and 84*f*.

Figure 36:
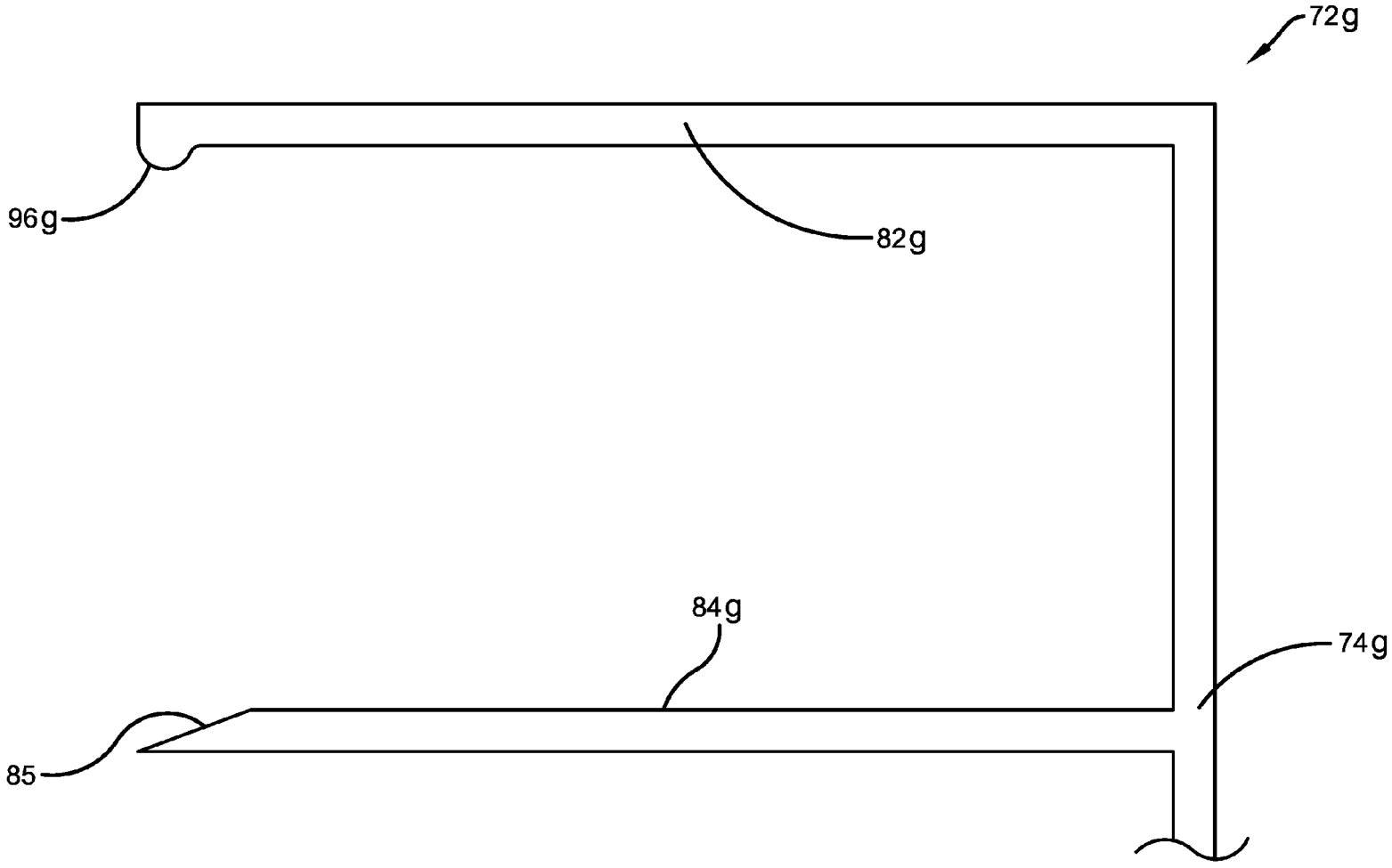
FIG. 36 illustrates a portion of another adaptor embodiment.

FIG. 36 shows a portion of another universal adaptor 72*g* which may be used to support a fenestration product (not shown) to a structure (not shown). The adaptor 72*g* may have a main wall 74*g* and first and second receiver walls 82*g* and 84*g*. Note that the distal end or tip of first receiver wall 82*g* may have a curved outer surface 96*g* similar to curved surface 96 described above. Note that the distal end or tip of second receiver wall 82*g* may have a beveled edge 85. The beveled edge 85 is useful in some embodiments to make it easier to insert the adaptor to a fenestration product and/or structure.

What should be clear is that universal adaptors of any type, style and size may be used according to this invention, as chosen with the sound judgment of a person of skill in the art, to secure a fenestration product to a structure. The various walls of the adaptor can be modified as needed for any particular application. Non-limiting examples include varying: the number of walls, their relative locations, their orientation (such as planar, curved, part planar and part curved, planar portions on different planes, etc.), their relative orientations, their widths, their thicknesses and their shapes (such as a curved outer surfaces and/or beveled edges as described above).

Figure 37:
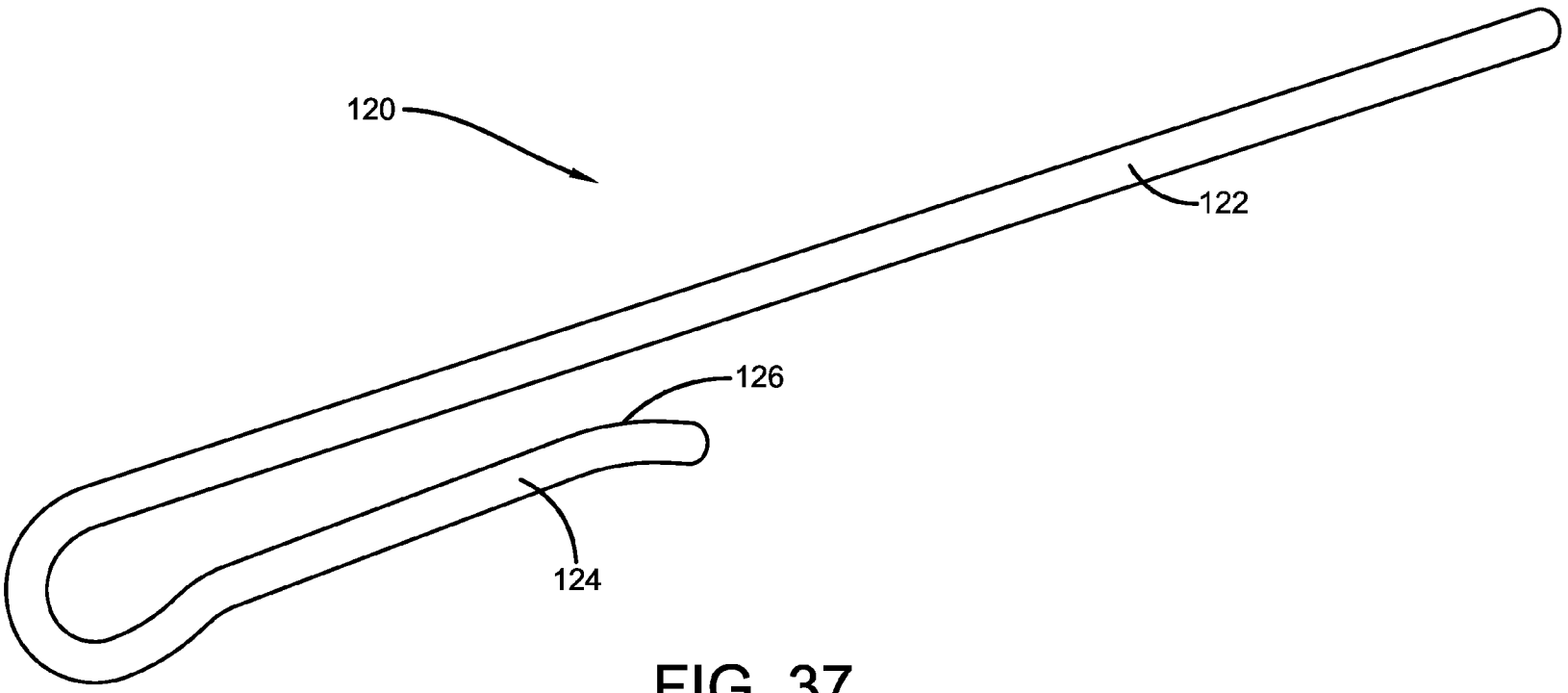
FIG. 37 is an end view of a trim piece according to some embodiments of this invention.

With reference now to FIG. 37, if desired a trim piece 120 may be used with an adaptor. Such a trim piece 120 may be used to improve the ornamental look of the fenestration product and/or the structure—similar to a window frame. The trim piece 120 may, for example, have a color and or design that matches at least one of the structure and the fenestration product. The trim piece 120 in one embodiment may comprise a pair of fingers 122, 124 that can be separated to receive a portion of the adaptor. In one embodiment, the trim piece may "clip" or "snap" onto any of the adaptor walls with a pressure fit between the fingers 122, 124 and the adaptor. While the particular design of the trim piece 120 can be any chosen with the sound judgment of a person of skill in the art, for the embodiment shown, finger 122 is wider than finger 124 and the tip of finger 124 is angled away from finger 122 (see reference 126) to make it easy to attach the trim piece 120 to the adaptor. The trim piece 120 may have any longitudinal length (into the page as shown in FIG. 37) as required. The longitudinal length of the trim piece 12 may be cut as required for any application. Once the trim piece (or pieces) 120 is (are) cut, it (they) can be attached to the adaptor (adaptors).

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved. When the word "associated" is used in the claims, it is intended to refer to a component which is not required for infringement. Instead, it is used only to refer to a component with which the claimed invention is used.

We claim:

1. A fenestration assembly for use with an associated structure having a structure opening that is defined by a periphery having a first portion with a first length along the periphery and a second portion with a second length along the periphery, the fenestration assembly comprising:

a fenestration product comprising: a first surface; a second surface; a third surface, a fourth surface and, an outer periphery that is similar in size and shape to the associated structure opening periphery;

a first adaptor piece comprising:

(1) a longitudinal length that:

(a) is greater than the first length; and, (b) defines first and second ends, wherein the first end comprises a first cutout section;

(2) a cross-sectional shape comprising:

(a) a laterally extending main wall having: a proximal end; a distal end opposite the proximal end; a first side; and, a second side opposite the first side;

(b) a support wall that extends laterally from the first side of the main wall; and, (c) a first receiver wall that extends laterally from the second side of the main wall;

a second adaptor piece comprising:

(1) a longitudinal length that:

(a) is greater than the second length; and, (b) defines first and second ends, wherein the first end comprises a first cutout section;

(2) a cross-sectional shape comprising:

(a) a laterally extending main wall having: a proximal end; a distal end opposite the proximal end; a first side; and, a second side opposite the first side;

(b) a support wall that extends laterally from the first side of the main wall; and, (c) a first receiver wall that extends laterally from the second side of the main wall;

wherein prior to installation of the window into the structure opening with the fenestration outer periphery juxtaposed to the structure opening periphery:

(1) the first adaptor piece is positioned with:

(a) the proximal end of the main wall extending into the structure opening with the second side of the main wall facing the first portion of the structure opening periphery;

(b) the distal end of the main wall extending outside the structure opening;

(c) at least one connector securing the main wall to the associated structure;

(d) the first receiver wall extending into the first cutout section of the second adaptor piece outside the structure opening periphery;

(2) the second adaptor piece is positioned with:

(a) the proximal end of the main wall extending into the structure opening with the second side of the main wall facing the second portion of the structure opening periphery;

(b) the distal end of the main wall extending outside the structure opening;

(c) at least one connector securing the main wall to the associated structure;

(d) the first receiver wall extending into the first cutout section of the first adaptor piece outside the structure opening periphery;

wherein after installation of the window into the structure opening with the fenestration outer periphery juxtaposed to the structure opening periphery:

(1) the first adaptor piece is positioned with:

(a) the proximal end of the main wall extending into the structure opening between the first portion of the structure opening periphery and the fenestration product with the second side of the main wall facing the first portion of the structure opening periphery and the first side of the main wall facing the first surface of the fenestration product; structure;

(b) the distal end of the main wall extending outside the structure opening;

(c) the at least one connector securing the main wall to the associated structure;

(d) the first receiver wall extending into the first cutout section of the second adaptor piece outside the structure opening periphery;

(2) the second adaptor piece is positioned with:

(a) the proximal end of the main wall extending into the structure opening between the second portion of the structure opening periphery and the fenestration product with the second side of the main wall facing the second portion of the structure opening periphery and the first side of the main wall facing the second surface of the fenestration product;

(b) the distal end of the main wall extending outside the structure opening;

(c) the at least one connector securing the main wall to the associated structure;

(d) the first receiver wall extending into the first cutout section of the first adaptor piece outside the structure opening periphery;

(3) the fenestration product is positioned with:

(a) the first surface supported to the first adaptor piece main wall;

(b) the second surface supported to the second adaptor piece main wall;

(c) the third surface supported to the first adaptor piece support wall; and, (d) the fourth surface supported to the second adaptor piece support wall.

2. The fenestration assembly of claim 1 wherein the first adaptor piece receiver wall overlaps the second adaptor piece receiver wall outside the structure opening.

3. The fenestration assembly of claim 1 wherein after installation of the window into the structure opening with the fenestration outer periphery juxtaposed to the structure opening periphery:

the first adaptor piece is positioned with the second side of the main wall contacting the first portion of the structure opening periphery and the second side of the main wall contacting the first surface of the fenestration product; and, the second adaptor piece is positioned with the second side of the main wall contacting the second portion of the structure opening periphery and the second side of the main wall contacting the second surface of the fenestration product.

4. The fenestration assembly of claim 1 wherein for both the first and second adaptor pieces:

the main wall is planar;

the support wall is planar;

the first receiver wall is planar;

the support wall extends substantially at a right angle with respect to the main wall; and, the first receiver wall extends substantially at a right angle with respect to the main wall.

5. The fenestration assembly of claim 1 wherein:

the first adaptor piece main wall has a length that is approximately equal to the first length;

the first adaptor piece first receiver wall has a length that is greater than the first length;

the second adaptor piece main wall has a length that is approximately equal to the second length; and, the second adaptor piece first receiver wall has a length that is greater than the second length.

6. The fenestration assembly of claim 1 wherein after installation of the window into the structure opening with the fenestration outer periphery juxtaposed to the structure opening periphery:

(1) the first adaptor piece is positioned with the at least one connector securing the proximal end of the main wall to the periphery of the associated structure; and, (2) the second adaptor piece is positioned with the at least one connector securing the main wall to the periphery of the associated structure.

7. The fenestration assembly of claim 1 wherein after installation of the window into the structure opening with the fenestration outer periphery juxtaposed to the structure opening periphery:

the fenestration product third surface is sealed to the first adaptor piece support wall with a caulking compound; and, the fenestration product fourth surface is sealed to the second adaptor piece support wall with a caulking compound.

8. The fenestration assembly of claim 1 wherein before installation of the window into the structure opening:

a single component has a first end defining the first adaptor piece and a second end opposite the first end defining the second adaptor piece.

9. The fenestration assembly of claim 1 wherein:

the associated structure opening periphery is rectangular in shape comprising first, second, third, and fourth sides;

the first portion of the structure opening periphery defines the first side of the structure opening periphery;

the second portion of the structure opening periphery defines the second side of the structure opening periphery;

a third portion of the structure opening periphery: defines the third side of the structure opening periphery; and, has a third length;

a fourth portion of the structure opening periphery: defines the fourth side of the structure opening periphery; and, has a fourth length;

the fenestration product further comprises fifth, sixth, seventh, and eighth surfaces;

the second end of the first adaptor piece comprises a second cutout section;

the second end of the second adaptor piece comprises a second cutout section;

a third adaptor piece comprises:

(1) a longitudinal length that:

(a) is greater than the third length; and, (b) defines first and second ends, wherein the first end comprises a first cutout section and the second end comprises a second cutout section;

(2) a cross-sectional shape comprising:
(a) a laterally extending main wall having: a proximal end; a distal end opposite the proximal end; a first side; and, a second side opposite the first side;
(b) a support wall that extends laterally from the first side of the main wall; and,
(c) a first receiver wall that extends laterally from the second side of the main wall;

a fourth adaptor piece comprises:
(1) a longitudinal length that:
(a) is greater than the fourth length; and,
(b) defines first and second ends, wherein the first end comprises a first cutout section and the second end comprises a second cutout section;
(2) a cross-sectional shape comprising:
(a) a laterally extending main wall having: a proximal end; a distal end opposite the proximal end; a first side; and, a second side opposite the first side;
(b) a support wall that extends laterally from the first side of the main wall; and,
(c) a first receiver wall that extends laterally from the second side of the wall;

wherein after installation of the window into the structure opening with the fenestration outer periphery juxtaposed to the structure opening periphery:
(1) the first adaptor piece is positioned with the first receiver wall extending into the first cutout section of the third adaptor piece outside the structure opening;
(2) the second adaptor piece is positioned with the first receiver wall extending into the first cutout section of the fourth adaptor piece outside the structure opening;
(3) the third adaptor piece is positioned with:
(a) the proximal end of the main wall extending into the structure opening between the third portion of the structure opening periphery and the fenestration product with the second side of the main wall facing the third portion of the structure opening periphery and the second side of the main wall facing the fifth surface of the fenestration product;
(b) the distal end of the main wall extending outside the structure opening;
(c) at least one connector securing the main wall to the associated structure;
(d) the first receiver wall extending into the second cutout section of the second adaptor piece outside the structure opening and into the second cutout section of the fourth adaptor piece outside the structure opening;
(4) the fourth adaptor piece is positioned with:
(a) the proximal end of the main wall extending into the structure opening between the fourth portion of the structure opening periphery and the fenestration product with the second side of the main wall facing the fourth portion of the structure opening periphery and the second side of the main wall facing the sixth surface of the fenestration product;
(b) the distal end of the main wall extending outside the structure opening;
(c) at least one connector securing the main wall to the associated structure;
(d) the first receiver wall extending into the second cutout section of the third adaptor piece outside the structure opening and into the second cutout section of the first adaptor piece outside the structure opening;
(5) the fenestration product is positioned with:
(a) the fifth surface supported to the third adaptor piece main wall;
(b) the sixth surface supported to the fourth adaptor piece main wall;
(c) the seventh surface supported to the third adaptor piece support wall; and,
(d) the eighth surface supported to the fourth adaptor piece support wall.

10. A fenestration assembly for use with an associated structure having a structure opening that is defined by a periphery having a first portion with a first length and a second portion with a second length, the fenestration assembly comprising:

a fenestration product comprising: a first surface; a second surface; a third surface, a fourth surface and, an outer periphery that is similar in size and shape to the associated structure opening periphery;

a first adaptor piece comprising:
(1) a longitudinal length that:
(a) is greater than the first length; and,
(b) defines first and second ends, wherein the first end comprises a first cutout section;
(2) a cross-sectional shape comprising:
(a) a laterally extending main wall having: a proximal end; a distal end opposite the proximal end; a first side; and, a second side opposite the first side;
(b) a support wall that extends laterally from the first side of the main wall; and,
(c) a first receiver wall that extends laterally from the second side of the main wall;

a second adaptor piece comprising:
(1) a longitudinal length that:
(a) is greater than the second length; and,
(b) defines first and second ends, wherein the first end comprises a first cutout section;
(2) a cross-sectional shape comprising:
(a) a laterally extending main wall having: a proximal end; a distal end opposite the proximal end; a first side; and, a second side opposite the first side;
(b) a support wall that extends laterally from the first side of the main wall; and,
(c) a first receiver wall that extends laterally from the second side of the main wall;

wherein after installation of the window into the structure opening with the fenestration outer periphery juxtaposed to the structure opening periphery:
(1) the first adaptor piece is positioned with:
(a) the proximal end of the main wall extending into the structure opening between the first portion of the structure opening periphery and the fenestration product with the second side of the main wall facing the first portion of the structure opening periphery and the first side of the main wall facing the first surface of the fenestration product; structure;
(b) the distal end of the main wall extending outside the structure opening;
(c) the at least one connector securing the main wall to the associated structure;
(d) the first receiver wall extending into the first cutout section of the second adaptor piece outside the structure opening periphery;
(2) the second adaptor piece is positioned with:
(a) the proximal end of the main wall extending into the structure opening between the second portion of the structure opening periphery and the fenestration product with the second side of the main wall facing the second portion of the structure opening periphery and the first side of the main wall facing the second surface of the fenestration product;

(b) the distal end of the main wall extending outside the structure opening;

(c) the at least one connector securing the main wall to the associated structure;

(d) the first receiver wall extending into the first cutout section of the first adaptor piece outside the structure opening periphery;

(3) the fenestration product is positioned with:

(a) the first surface supported to the first adaptor piece main wall;

(b) the second surface supported to the second adaptor piece main wall;

(c) the third surface supported to the first adaptor piece support wall; and, (d) the fourth surface supported to the second adaptor piece support wall;

wherein:

the associated structure comprises first and second siding panels positioned on the structure next to the structure opening;

the first adaptor piece comprises: a second cutout section at the first end; and a second receiver wall that extends laterally from the second side of the main wall;

the second adaptor piece comprises: a second cutout section at the first end; and, a second receiver wall that extends laterally from the second side of the main wall;

after installation of the window into the structure opening with the fenestration outer periphery juxtaposed to the structure opening periphery:

(1) the first adaptor piece is positioned with the second receiver wall extending into the second cutout section of the second adaptor piece outside the structure opening;

(2) the second adaptor piece is positioned with the second receiver wall extending into the second cutout section of the first adaptor piece outside the structure opening;

(3) at least a portion of the first siding panel is positioned between the first and second receiver walls of the first adaptor; and, (4) at least a portion of the second siding panel is positioned between the first and second receiver walls of the second adaptor.

* * * * *